US008665290B2

(12) United States Patent
Sloan

(10) Patent No.: US 8,665,290 B2
(45) Date of Patent: Mar. 4, 2014

(54) IMAGE-BASED SOURCE GAMUT ADJUSTMENT FOR COMPRESSION-TYPE GAMUT MAPPING ALGORITHM

(75) Inventor: Rocklin Sloan, San Jose, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 925 days.

(21) Appl. No.: 12/474,272

(22) Filed: May 28, 2009

(65) Prior Publication Data

US 2010/0302271 A1 Dec. 2, 2010

(51) Int. Cl.
*G09G 5/02* (2006.01)

(52) U.S. Cl.
USPC ..... 345/590; 345/589; 345/604; 382/165; 382/167; 382/168; 382/170

(58) Field of Classification Search
USPC ..... 345/590; 382/165, 167, 168, 170, 589, 382/604
See application file for complete search history.

(56) References Cited

U.S. PATENT DOCUMENTS

| | | | | |
|---|---|---|---|---|
| 5,987,165 | A * | 11/1999 | Matsuzaki et al. | 382/162 |
| 6,198,843 | B1 | 3/2001 | Nakauchi et al. | |
| 6,373,595 | B1 * | 4/2002 | Semba et al. | 358/1.9 |
| 6,646,762 | B1 | 11/2003 | Balasubramanian et al. | |
| 6,719,392 | B2 * | 4/2004 | Qiao | 347/15 |
| 6,873,439 | B2 | 3/2005 | Levy et al. | |
| 6,882,445 | B1 | 4/2005 | Takahashi et al. | |
| 7,064,864 | B2 | 6/2006 | Takahashi et al. | |
| 7,082,227 | B1 * | 7/2006 | Baum et al. | 382/311 |
| 7,116,441 | B1 | 10/2006 | Matsuoka | |
| 7,221,482 | B2 | 5/2007 | Yamazaki et al. | |
| 7,408,678 | B1 | 8/2008 | MacLeod | |
| 7,421,117 | B2 | 9/2008 | Kondo et al. | |
| 2002/0163669 | A1 | 11/2002 | Yamazaki et al. | |
| 2003/0001860 | A1 | 1/2003 | Yamazaki et al. | |
| 2003/0174885 | A1 | 9/2003 | Levy et al. | |
| 2005/0128496 | A1 | 6/2005 | Bala | |
| 2005/0248784 | A1 | 11/2005 | Henley et al. | |
| 2006/0072133 | A1 | 4/2006 | Han et al. | |
| 2006/0170940 | A1 | 8/2006 | Kang et al. | |
| 2006/0221396 | A1 | 10/2006 | Sloan | |

(Continued)

OTHER PUBLICATIONS

H. Kotera, et al., "Image-dependent Color Mapping for Pleasant Image Renditions", 2001, Dept. Information and Images Sciences, Chiba University, Japan.
M. Bourgoin, "Windows Color System: Evolution in the Microsoft Color Management Ecosystem", 2005, Microsoft Corporation.
L. Vasudevan, et al., "Windows Color System Overview", Microsoft Corporation, WinHec 2005.

(Continued)

*Primary Examiner* — Xiao M. Wu
*Assistant Examiner* — Kim-Thanh T Tran
(74) *Attorney, Agent, or Firm* — Fitzpatrick, Cella, Harper & Scinto

(57) ABSTRACT

Color management which converts source device colors into counterpart colors in a destination device color space. Device independent source and destination device gamut boundaries are obtained. A color image is generated in the source device color space. The color image is transformed into an image in a device independent color space. A gamut boundary for the device independent image is generated, based on the content of the device independent image. The source device gamut boundary is shrunk in a hue symmetric manner, such that color hues do not change, until it touches the image gamut boundary. Colors of the device independent image are mapped onto a gamut of the destination device by invoking a compression-type gamut mapping algorithm that uses the modified source device gamut boundary and the destination device gamut boundary to perform gamut mapping. The gamut mapped colors are converted into colors in destination device dependent color space.

60 Claims, 18 Drawing Sheets

(56) References Cited

U.S. PATENT DOCUMENTS

| | | | | |
|---|---|---|---|---|
| 2006/0244982 | A1 | 11/2006 | Zeng | |
| 2006/0244983 | A1 | 11/2006 | Zeng | |
| 2006/0274340 | A1 | 12/2006 | Yamazoe | |
| 2007/0086028 | A1 | 4/2007 | Cho et al. | |
| 2007/0091335 | A1 | 4/2007 | Shaw et al. | |
| 2007/0139677 | A1 | 6/2007 | Kwak et al. | |
| 2007/0236506 | A1 | 10/2007 | Tin | |
| 2007/0236761 | A1 | 10/2007 | Sloan | |
| 2008/0068626 | A1 | 3/2008 | Bala et al. | |
| 2009/0310157 | A1* | 12/2009 | Wada | 358/1.9 |

OTHER PUBLICATIONS

J. Morovic, et al., "The Fundamentals of Gamut Mapping: A Survey", Journal of Imaging Science and Technology, 2001, pp. 283-290, v. 45, No. 3.

"WCS Gamut Map Model Profile Schema and Algorithms", 2008, Microsoft Corporation, obtained on Dec. 8, 2008 at: http://msdn.microsoft.com/en-us/library/ms536899(VS.85,printer).aspx.

M. Stokes, "How WCS in Windows Vista works with Drivers and Applications", 2006, Microsoft Corporation.

* cited by examiner

IMAGE-BASED SOURCE GAMUT ADJUSTMENT FOR COMPRESSION-TYPE GAMUT MAPPING ALGORITHM

FIELD OF THE INVENTION

The present disclosure relates to color management systems, and more particularly relates to color management systems that use compression-type gamut mapping algorithms.

BACKGROUND

Color management systems (CMS) perform gamut mapping to convert color between color device representations of a source and a destination color device. To perform this conversion, color values for a color space of the source device are converted into color values for a device independent color space, and thereafter, these device-independent color values are converted into values for a color space of the destination device.

Because a source device (e.g., a digital camera) and a destination device (e.g., a printer) typically have different color gamuts with respect to each other, a gamut mismatch may occur, meaning that some colors within the source device's color space may not be represented within the destination device's color space. Often, a destination device gamut is smaller than the source device gamut because the source device is capable of producing more colors than the destination device. To achieve an intended reproduction of source colors on the destination device, gamut mapping is performed.

Gamut mapping is the process of mapping colors in the source device gamut onto the destination device gamut. Gamut mapping is often performed using a compression-type gamut mapping algorithm (GMA). Compression-type GMAs use source and destination device gamut boundaries to determine the amount of compression (movement) needed to map a color point in the source device gamut onto the destination device gamut. Examples of compression-type GMAs include midpoint compression, cusp point compression and knee point compression GMAs.

FIG. 1 shows a typical architecture for gamut mapping using a compression-type GMA. Source device gamut boundary 11 is created from a source device model by a source device gamut boundary module 10 and destination device gamut boundary 13 is created from a destination device model by destination device gamut boundary module 12. Source device gamut boundary 11 and destination device gamut boundary 13, together with source image colors 14, are provided to compression-type GMA 15. Compression-type GMA 15 is applied to source image colors 14 in order to map source image colors 14 to destination colors 16, using source device gamut boundary 11 and destination device gamut boundary 13.

Compression-type GMAs perform color conversion according to various color reproduction intents which define a desired relationship between the source and destination color values. The intent of the GMA dictates the direction and magnitude of compression. For example, a GMA can perform with an intent to maintain accuracy of the original image or with an intent to maximize pleasantness to a viewer. Often, compression-type GMAs preserve the details of an image. However if too much compression is performed, some of the colorfulness (i.e., chroma) of the image may be lost.

Other types of GMAs include image-based GMAs and clipping-type GMAs. Image-based GMAs use various image characteristics to determine gamut mapping for the colors of the image. Clipping-type GMAs generally map colors which are outside of the destination gamut to a color point on the destination gamut boundary. Colors which are already contained in the destination gamut are not affected. Often, clipping-type GMAs preserve the colorfulness (i.e., chroma) of an image. However, the use of a clipping-type GMA may cause some image detail in the colorful areas to be lost.

Generally, movement of color points during gamut mapping is undesirable because movement alters color appearance. Therefore, it is ordinarily desirable to minimize the movement of color points during gamut mapping.

SUMMARY

One problem with compression-type GMAs is that when an image gamut does not fill the source device gamut, the compression factor may be greater than necessary to map colors in a source image onto the gamut of the destination device. In this case, the compression-type GMA may not provide optimum preservation of color accuracy.

One problem with image-based GMAs is that when one image color is more saturated than another, the amount of compression may vary dramatically for different color points. For example, if an image contains a lot of saturated red, but has very little saturated green, the red may be compressed much more than the green. This difference in compression often results in an unnatural appearance.

The foregoing is addressed by using a boundary of a source image to affect gamut mapping. The gamut boundary of the source image is the color gamut boundary that fully encompasses all of the colors contained in the image.

Thus, in an example embodiment described herein, color management is architected so as to convert a source-side color in a source device dependent color space into a counterpart destination-side color in a destination device dependent color space. A device independent source device gamut boundary for a source device and a device independent destination device gamut boundary for a destination device are obtained. A source color image is generated in the source device dependent color space. The source color image is transformed into a device independent image in a device independent color space. An image gamut boundary for the device independent image is generated, based on the content of the device independent image. The source device gamut boundary is modified by shrinking the source device gamut boundary in a hue symmetric manner, such that hues of colors do not change, until it touches the image gamut boundary. The colors of the device independent image are mapped onto a gamut of the destination device by invoking a compression-type gamut mapping algorithm that uses the modified source device gamut boundary and the destination device gamut boundary to perform gamut mapping. The gamut mapped colors are converted into destination-side colors in the destination device dependent color space.

By virtue of shrinking the source device gamut boundary towards the image gamut boundary, the amount of compression may be reduced, thereby improving color accuracy. By virtue of shrinking the source device gamut boundary in a hue symmetric manner, the amount of compression for each color may not vary, and a more natural appearance may result. By virtue of applying the modified source device gamut boundary to a compression-type GMA, existing compression-type GMAs may be used.

In example embodiments, the source device gamut boundary can be shrunk according to the intent of the compression-type GMA. A compression point can be determined based on the intent of the compression-type GMA, and the source device gamut boundary can be modified by moving each point on the source device gamut boundary toward the compression point until a point on the modified source device gamut boundary touches the image gamut boundary.

In response to a determination that the compression-type GMA performs lightness scaling, a lightness of the source device gamut boundary can be scaled so that maximum and minimum values of the lightness of the source device gamut boundary match maximum and minimum values of a lightness of the destination device gamut boundary. The lightness-scaled source device gamut boundary can be shrunk during modification such that only chroma components of the source device gamut boundary are modified. The modified source device gamut boundary can be re-scaled to an original lightness and used by the compression-type GMA. The lightness-scaled source device gamut boundary can be in a color space having at least a coordinate representing lightness and a coordinate representing chroma, and the lightness-scaled source device gamut boundary can be modified by moving a chroma component of each point on the lightness-scaled source device gamut boundary toward an axis representing the lightness coordinate, until a point on the modified source device gamut boundary touches the image gamut boundary.

An additional shrinking step can be performed to further shrink the source device gamut boundary past the image gamut boundary until a predetermined condition is satisfied. The predetermined condition can be based on a percentage of the device independent image color points that lie outside of the modified source device gamut boundary. The predetermined condition can be based on a threshold number of the device independent image color points that lie outside of the modified source device gamut boundary. The predetermined condition can be based on a maximum distance between a color point of the device independent image that lies outside of the modified source device gamut boundary, and the modified source device gamut boundary. The predetermined condition can be satisfied when the modified source device gamut boundary touches the destination device gamut boundary. The predetermined condition can be selected by a user. The predetermined condition can be selected using a graphical user interface that provides a preview of a resulting image.

After performing the additional shrinking step, one or more color points of the device independent image may lie outside of the modified source device gamut boundary. The outlying color points of the device independent image that lie outside the modified source device gamut boundary may lie outside the destination device gamut boundary after the compression-type GMA performs gamut mapping. Post-processing can be performed to convert the outlying color points into color points that lie within the destination device gamut boundary. The post-process can include clipping the outlying color points that lie outside of the destination device gamut boundary to a nearest color point on the destination device gamut boundary. In the alternative, a compression method can be performed during post-processing.

This brief summary has been provided so that the nature of this disclosure may be understood quickly. A more complete understanding can be obtained by reference to the following detailed description and to the attached drawings.

DETAILED DESCRIPTION

First Embodiment

Figure 1:
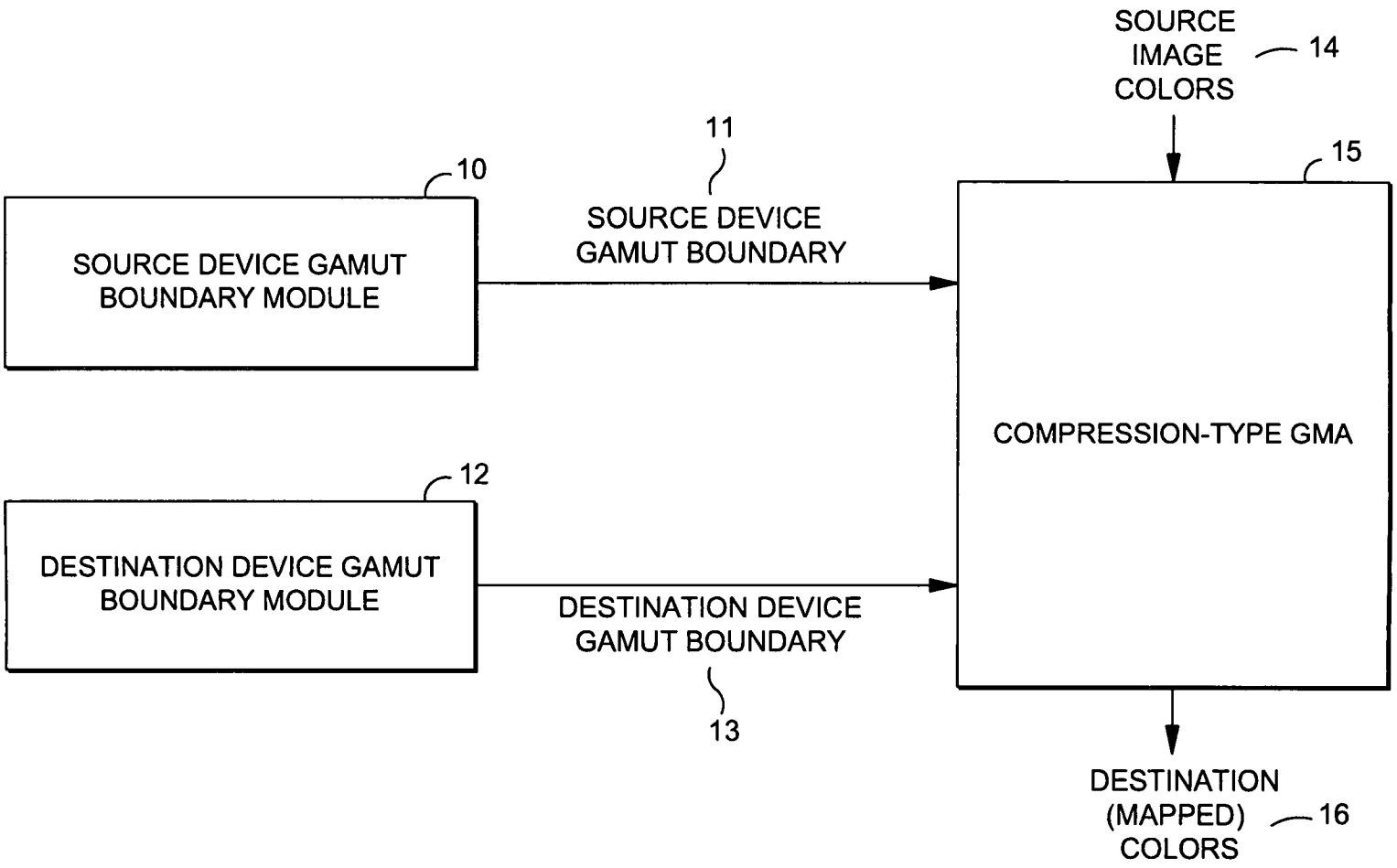
FIG. 1 PRIOR ART
FIG. 1 is a view for explaining a typical software architecture for gamut mapping using a compression-type GMA.
Figure 2:
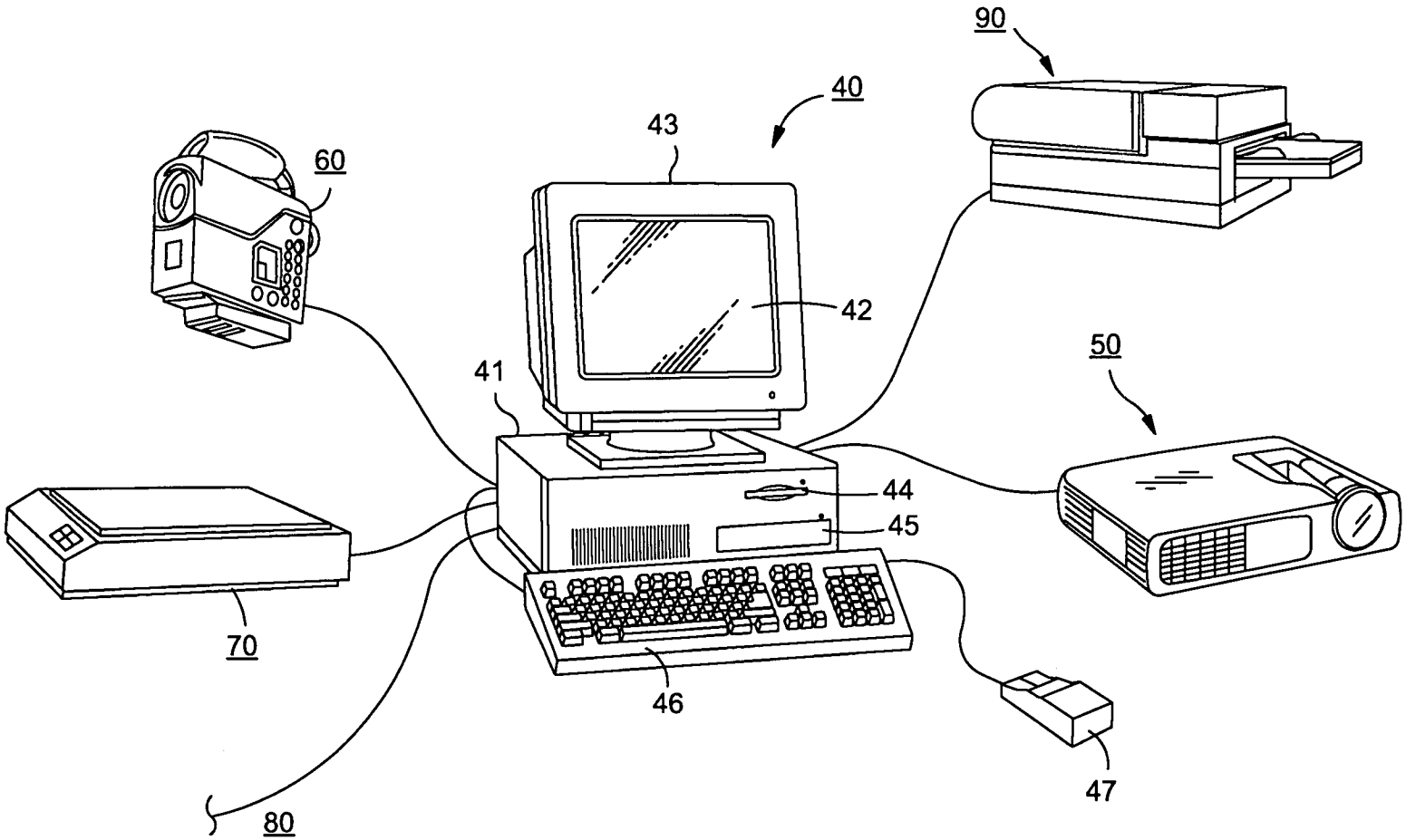
FIG. 2 is a representative view of computing equipment relevant to one example embodiment.

FIG. 2 is a representative view of computing equipment, peripherals and digital devices, relevant to a first example embodiment. Computing equipment 40 includes host computer 41 which generally comprises a programmable general purpose personal computer (hereinafter "PC") having an operating system such as Microsoft® Windows® or Apple® Mac OS® or LINUX, and which is programmed as described below so as to perform particular functions and in effect to become a special purpose computer when performing these functions. Computing equipment 40 includes color monitor 43 including display screen 42, keyboard 46 for entering text data and user commands, and pointing device 47. Pointing device 47 preferably comprises a mouse for pointing and for manipulating objects displayed on display screen 42.

Host computer 41 also includes computer-readable memory media such as computer hard disk 45 and DVD disk drive 44, which are constructed to store computer-readable information such as computer-executable process steps. DVD disk drive 44 provides a means whereby host computer 41 can access information, such as image data, computer-executable process steps, application programs, etc. stored on removable memory media. In an alternative, information can also be retrieved through other computer-readable media such as a USB storage device connected to a USB port (not shown), or through network interface 80. Other devices for accessing information stored on removable or remote media may also be provided.

Projector 50 is a first example of a color output device, and in this example is an RGB or RGBW projector, such as a DLP™ digital projector or other display device that projects images in accordance with image data from host computer 41 onto a projection screen (not shown).

Printer 90 is a second example of a color output device, and in this example is a color laser printer which forms color images on a recording medium such as paper or transparencies or the like. Printer 90 forms color images using cyan, magenta, yellow and black colorants, although printers and other devices can be used which form color images using other colorant combinations that might or might not include black, such as a CMYKOG device.

Digital color scanner 70 is a first example of a color input device, and is provided for scanning documents and images and sending the corresponding image data to host computer 41.

Digital color camera 60 is a second example of a color input device, and is provided for sending digital image data to host computer 41.

Of course, host computer 41 may acquire digital image data from other sources such as a digital video camera, a local area network or the Internet via network interface 80. Likewise, host computer 41 may interface with other color output devices, such as color output devices accessible over network interface 80.

Figure 3:
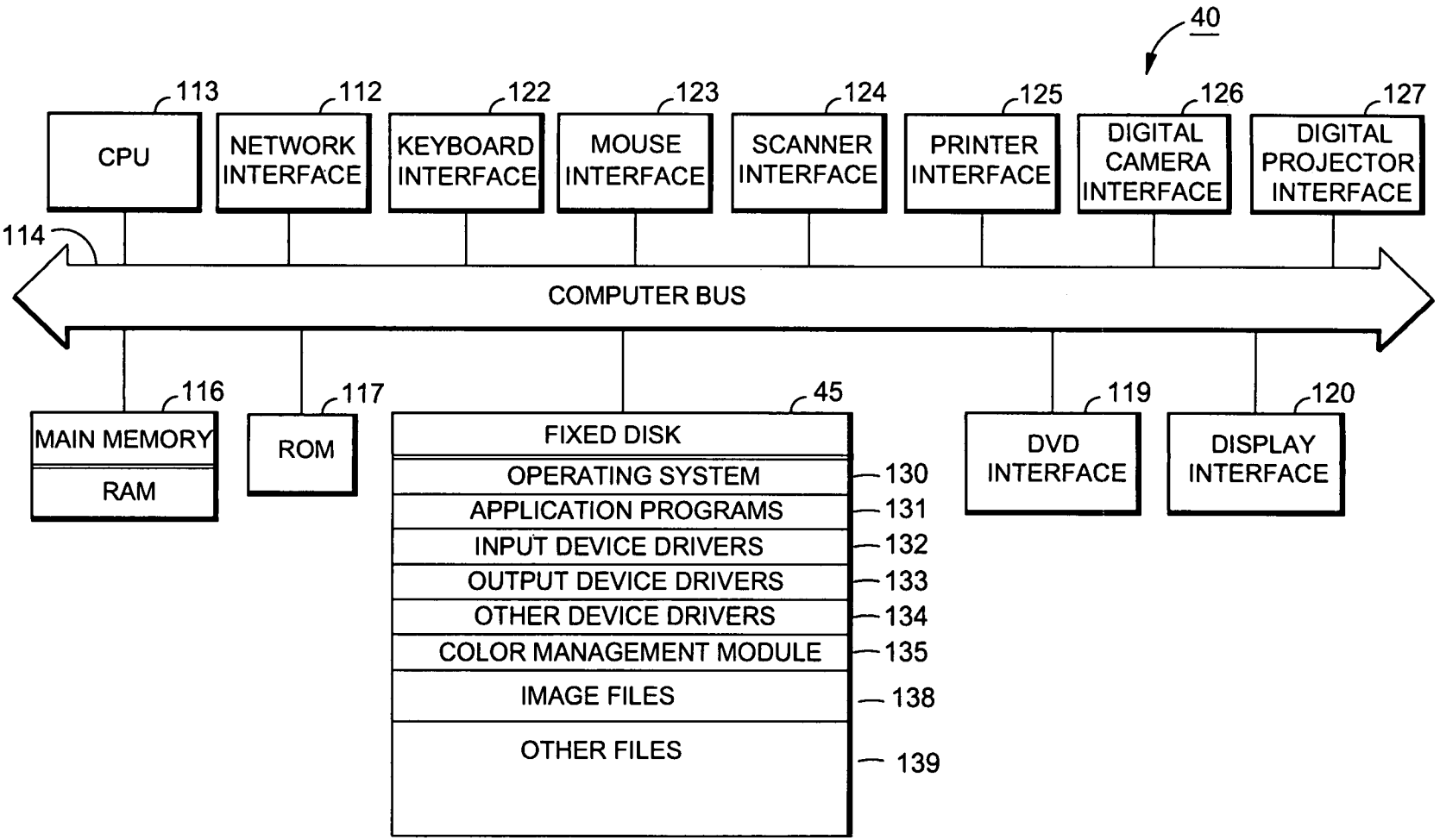
FIG. 3 is a detailed block diagram depicting the internal architecture of the host computer shown in FIG. 2.

FIG. 3 is a detailed block diagram showing the internal architecture of host computer 41 of computing equipment 40. As shown in FIG. 3, host computer 41 includes central processing unit (CPU) 113 which interfaces with computer bus 114. Also interfacing with computer bus 114 are hard disk 45, network interface 112, random access memory (RAM) 116 for use as a main run-time transient memory, read only memory (ROM) 117, DVD disk interface 119, display interface 120 for monitor 43, keyboard interface 122 for keyboard 46, mouse interface 123 for pointing device 47, scanner interface 124 for scanner 70, printer interface 125 for printer 90, digital camera interface 126 for digital camera 60, and digital projector interface 127 for digital projector 50.

RAM 116 interfaces with computer bus 114 so as to provide information stored in RAM 116 to CPU 113 during execution of the instructions in software programs such as an operating system, application programs, color management modules, and device drivers. More specifically, CPU 113 first loads computer-executable process steps from fixed disk 45, or another storage device into a region of RAM 116. CPU 113 can then execute the stored process steps from RAM 116 in order to execute the loaded computer-executable process steps. Data such as color images or other information can be stored in RAM 116, so that the data can be accessed by CPU 113 during the execution of computer-executable software programs, to the extent that such software programs have a need to access and/or modify the data.

As also shown in FIG. 3, hard disk 45 contains computer-executable process steps for operating system 130, and application programs 131, such as word processing programs or a graphical image management programs. Hard disk 45 also contains computer-executable process steps for device drivers for software interface to devices, such as input device drivers 132, output device drivers 133, and other device drivers 134. Image files 138, including color image files, and other files 139 are available for output to color output devices and for manipulation by application programs.

Color management module (CMM) 135 comprises computer-executable process steps executed by a computer for managing colors so as to maintain good color fidelity for color images that are transferred from a source device to a destination device, such as the transfer of color image data from capture by digital camera 60 to display by projector 50. CMM 135 generally comprises computer-executable process steps that accept a source color image having colors with colorant values in a source device dependent color space, and that generate a destination color image having colors with counterpart colorant values in a destination device dependent color space. More specifically, CMM 135 obtains a device independent source device gamut boundary for a source device and a device independent destination device gamut boundary for a destination device. CMM 135 obtains a source color image in the source device dependent color space and transforms the source color image into a device independent image in a device independent color space. CMM 135 generates an image gamut boundary for the device independent image based on the color content of the device independent image. CMM 135 modifies the source device gamut boundary by shrinking the source device gamut boundary in a hue symmetric manner, such that hues of colors do not change, until it touches the image gamut boundary, and maps colors of the device independent image onto a gamut of the destination device by invoking a compression-type gamut mapping algorithm that uses the modified source device gamut boundary and the destination device gamut boundary to perform gamut mapping, wherein the gamut mapped colors are converted into destination-side colors in the destination device dependent color space.

The computer-executable process steps for CMM 135 may be configured as a part of operating system 130, as part of a device driver such as a printer driver, or as a stand-alone application program such as a color management system. They may also be configured as a plug-in or dynamic link library (DLL) to the operating system, device driver or application program. For example, CMM 135 according to example embodiments may be incorporated in a device driver for execution in a computing device, such as a printer driver, embedded in the firmware of a device, such as a printer, or provided in a stand-alone color management application for use on a general purpose computer. In one example embodiment described herein, CMM 135 is incorporated directly into the operating system for general purpose host computer 41. It can be appreciated that the present disclosure is not limited to these embodiments and that the disclosed color management module may be used in other environments in which color management is used.

Figure 4:
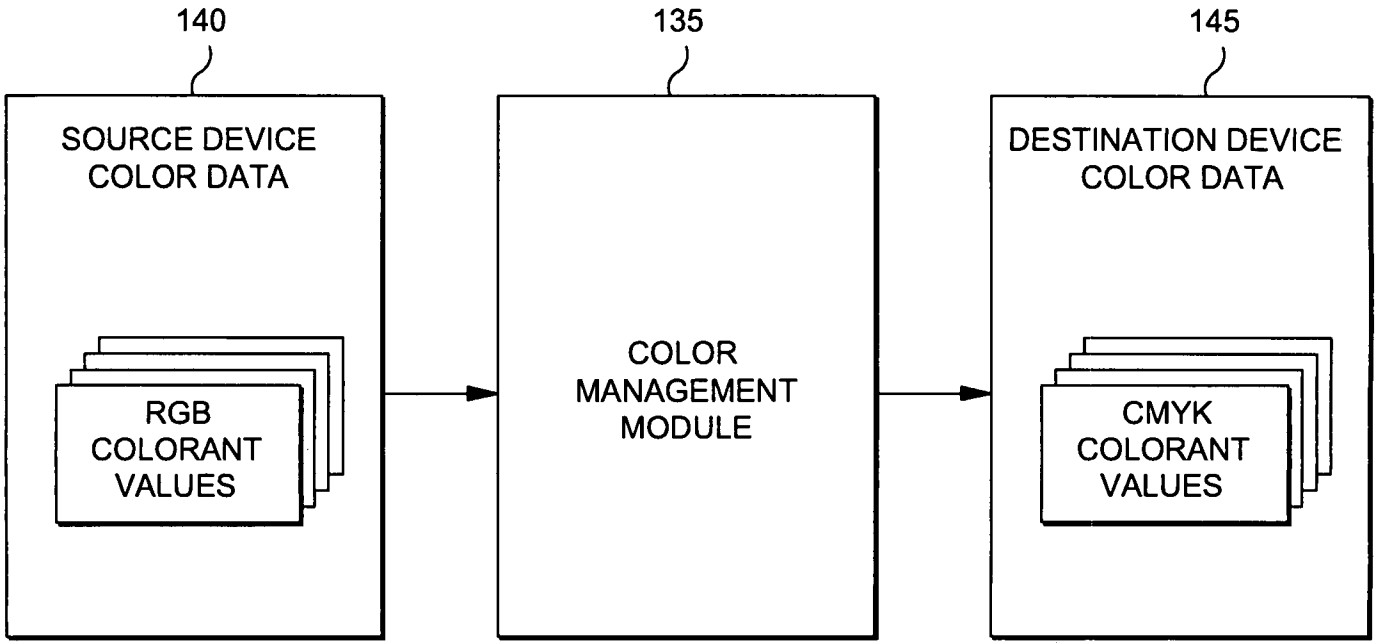
FIG. 4 is a representational view of color transform processing performed by a color management module according to an example embodiment.

FIG. 4 shows a representational view of color transform processing performed by a color management system. As explained hereinabove, a source color image 140 for a source device contains colorant values in a source device dependent color space, such as RGB colorant values in an RGB color space for a scanner or camera or LCD display. CMM 135 is applied to the source device colorant values so as to obtain a counterpart color image 145 for a destination device. Because of the effect of processing by CMM 135, the destination color image 145 exhibits good color fidelity relative to the source color image 140, despite a change from the source device to the destination device, and despite other changes such as changes in viewing conditions and output media. Color image 145 contains colorant values in the destination device dependent color space, such as CMYK colorant values in a CMYK color space for a color laser printer.

In use of CMM 135, nearly any device can serve as the source device, and nearly any device can serve as the destination. In one example, the source device might be digital camera 60 which captures an image of a natural scene, and the destination device might be color laser printer 90 which produces a printout of the captured image. In other examples, the source device might be color laser printer 90 printer which has produced a printout of a color image, and the destination device might be scanner 70 which scans the printout. In another example, the source device might be display 43 which is displaying a color image, and the destination device might be projector 50 for which it is desired to project a counterpart color image with good fidelity to the image being displayed by the display 43. In further examples of use of CMM 135, projector 50 can operate either as a source device or as a destination device. One example of projector 50 operating as a source device is in a situation where it is desired to print an image on printer 90 in correspondence to an image being projected by projector 50. One example of projector 50 operating as a destination device is a situation where it is desired to project an image corresponding to an image captured by digital camera 60. Other examples are situations where it is desired to project an image in correspondence to an image scanned by scanner 70, or displayed by display 43 on screen 42. Other combinations and permutations are possible and will be evident to those of ordinary skill in the art.

Figure 5:
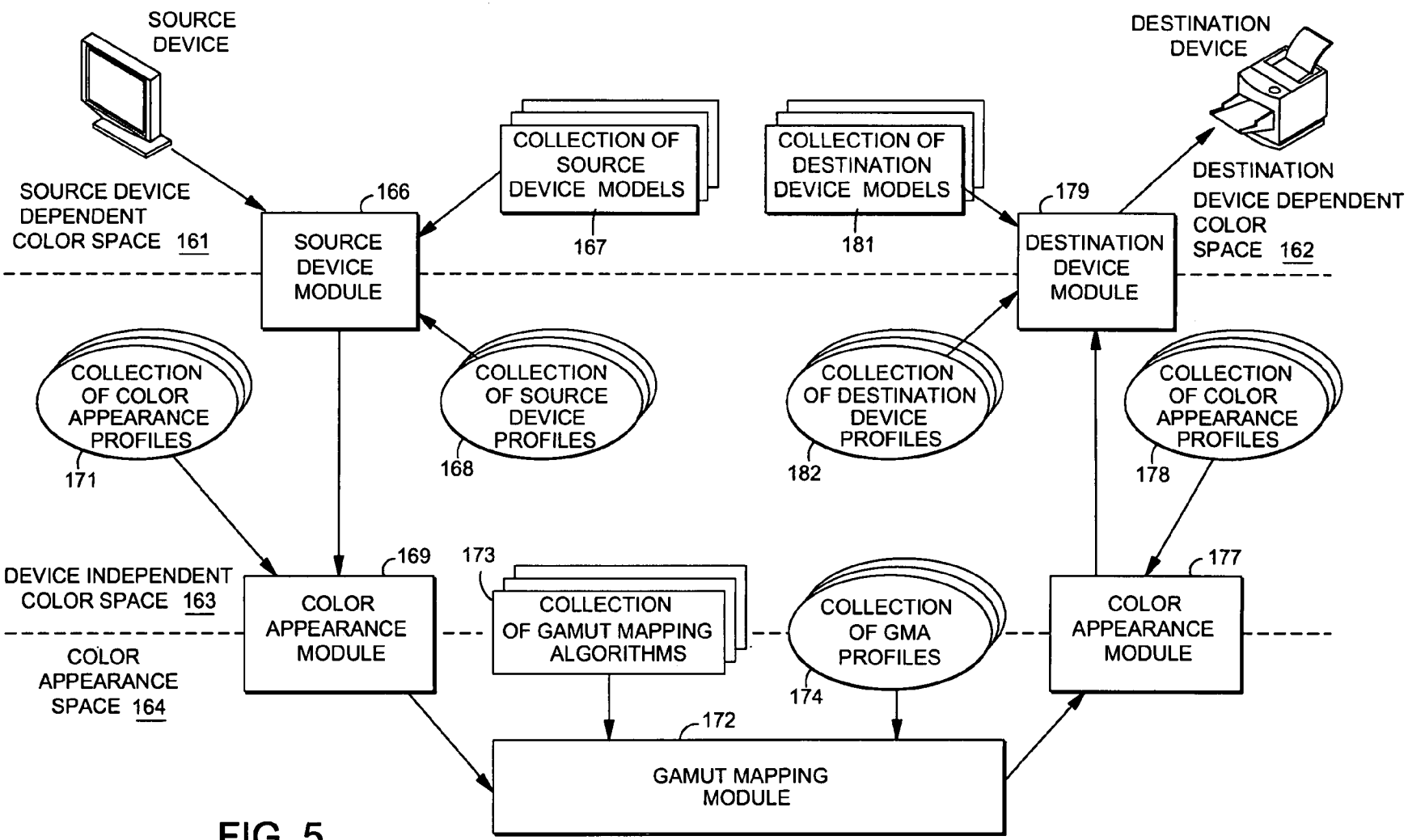
FIG. 5 is a view for explaining software architecture of a color management module according to an example embodiment.

FIG. 5 is a view for explaining software architecture of CMM 135 according to the first example embodiment. As seen in FIG. 5, CMM 135 is architected in multiple layers, with a module in each layer communicating with modules in each of two adjacent layers. The layers correspond generally to different color spaces, and also to colors that have been gamut-mapped or that have not yet been gamut-mapped. Thus, there are layers for a source device dependent color space 161 (such as an sRGB color space) and a destination device dependent color space 162 (such as a CMYK color space), layers for device independent color spaces 163 (such as CIEXYZ color space, although the device independent color space on the source device side is not necessarily the same as the device independent color space on the destination device side), and layers for device independent color appearance spaces 164 (such as CIECAM02 JCh color space, but which likewise are not necessarily the same color spaces on the source side and the destination device side). This latter layer for device independent color appearance spaces 164 includes colors which have not yet been gamut-mapped and those which have.

A detailed description of the modules in the various layers will now be provided.

A source device module 166 transforms colors in source device dependent color space 161 into counterpart colors in the device independent color space 163, by using a source device model. The source device model implemented by source device module 166 is one of multiple selectable models, with the selection being made from a collection 167 of source device models. The collection includes pre-defined baseline models which might include, for example, a CRT device model, an LCD device model, an RGB capture device model, an RGB projector device model, an RGB printer device model, a CMYK printer device model, an RGB virtual device model (which can be used for wcsRGB color space), or an ICC (International Color Consortium) virtual device model (which enables use of ICC profiles in measurement-based transforms used herein). In addition, the selection of the source device model that is used by source device module 166 is extensible via a device model plug-in, so as to permit use of a device model for a device that does not conform closely enough to one of the pre-defined device models.

Source device module 166 implements parameters of the selected device model by using a source device profile which characterizes parameters for the particular device under consideration. As one example of the difference between a device model and a device profile, the device model might accurately model an entire family of devices, such as LCD displays, in terms of parameters such as white point and black point. The device profile provides values for these parameters, individualized for one particular device within the family. In this embodiment, the device profiles (both source device and destination device) are provided in the form of measurements of color performance for the target device.

The source device profile is normally provided to the source device module 166 from a collection 167 of pre-defined source device profiles, corresponding to devices that are installed on host computer 41.

Source colors in device independent color space 163 are mapped to device independent color appearance space 164 by color appearance module 169, which transforms colors based on a color appearance model profile (CAMP). The CAMP provides a measure of viewing conditions at the source device. The source device CAMP may be selected from a collection 171 of pre-defined CAMPs, which typify frequently encountered viewing conditions.

Source colors in device independent color appearance space 164 are then gamut mapped by a gamut mapping module 172 which implements a gamut-mapping model so as to obtain gamut-mapped colors in device independent color appearance space 164. The purpose of the gamut-mapping module 172 is to reconcile the differences in the gamut of colors reproducible by the source device as against the gamut of colors reproducible by the destination device. These two gamuts are almost always different, and thus colors in source device dependent color space 161 almost always require adjustment when calculating counterpart colors in destination device dependent color space 162.

Gamut mapping module 172 typically implements a GMA selected from a collection 173 of GMAs. For example, the collection might include one or more of the following compression-type GMAs: (a) a midpoint compression GMA; (b) a cusp point compression GMA; (c) a knee point compression GMA; and (d) a sigmoidal Gaussian knee clipping algorithm (SGKC), which is largely equivalent to ICC's preferred, pictorial, or perceptual intent. In addition, the selection for the gamut mapping module 172 is typically extensible via a plug-in framework, so as to permit use of a gamut mapping model that does not conform closely enough to one of the pre-defined GMAs.

A gamut mapping profile is provided to gamut mapping module 172, wherein the profile provides values for parameters in the GMA, and wherein the profile is selectable from among a collection 174 of pre-defined gamut mapping profiles. A gamut mapping profile can include information regarding lightness-scaling and the intent of the GMA.

Gamut-mapped colors in device independent color appearance space 164 are mapped to counterpart colors in device independent color space 163 by color appearance module 177, which transforms colors based on a color appearance model profile (CAMP). The CAMP provides a measure of viewing conditions at the destination device. The destination device CAMP may be selected from a collection 178 of pre-defined CAMPs, which typify frequently encountered viewing conditions.

Colors in device independent color space 163 are transformed into counterpart colors in the destination device dependent color space 162 by destination device module 179, which transforms colors in the device independent color space 163 into counterpart colors in the destination device dependent color space 162 by using a destination device model. Like the source device model, the destination device model implemented by destination device module 179 is one of multiple selectable models, with the selection being made from a collection 181 of destination device models. The collection might be the same collection as source device collection 167, and includes pre-defined baseline models such as a CRT device model, an LCD device model, an RGB capture device model, an RGB projector device model, an RGB printer device model, a CMYK printer device model, an RGB virtual device model (which can be used for wcsRGB color space), or an ICC virtual device model (which enables use of ICC profiles in measurement-based transforms used herein). In addition, the selection for the destination device model that is used by destination device module 179 is extensible via a device model plug-in, so as to permit use of a device model for a device that does not conform closely enough to one of the pre-defined device models.

Similar to the source side, destination device module 179 implements parameters of the selected device model by using a destination device profile which characterizes parameters for the particular device under consideration. As before, in this example embodiment, the destination device profile is provided in the form of measurements of color performance for the target device. The destination device profile is normally provided to the destination device module 179 from a collection 182 of pre-defined destination device profiles, corresponding to devices that are installed on host computer device 41.

Figure 6:
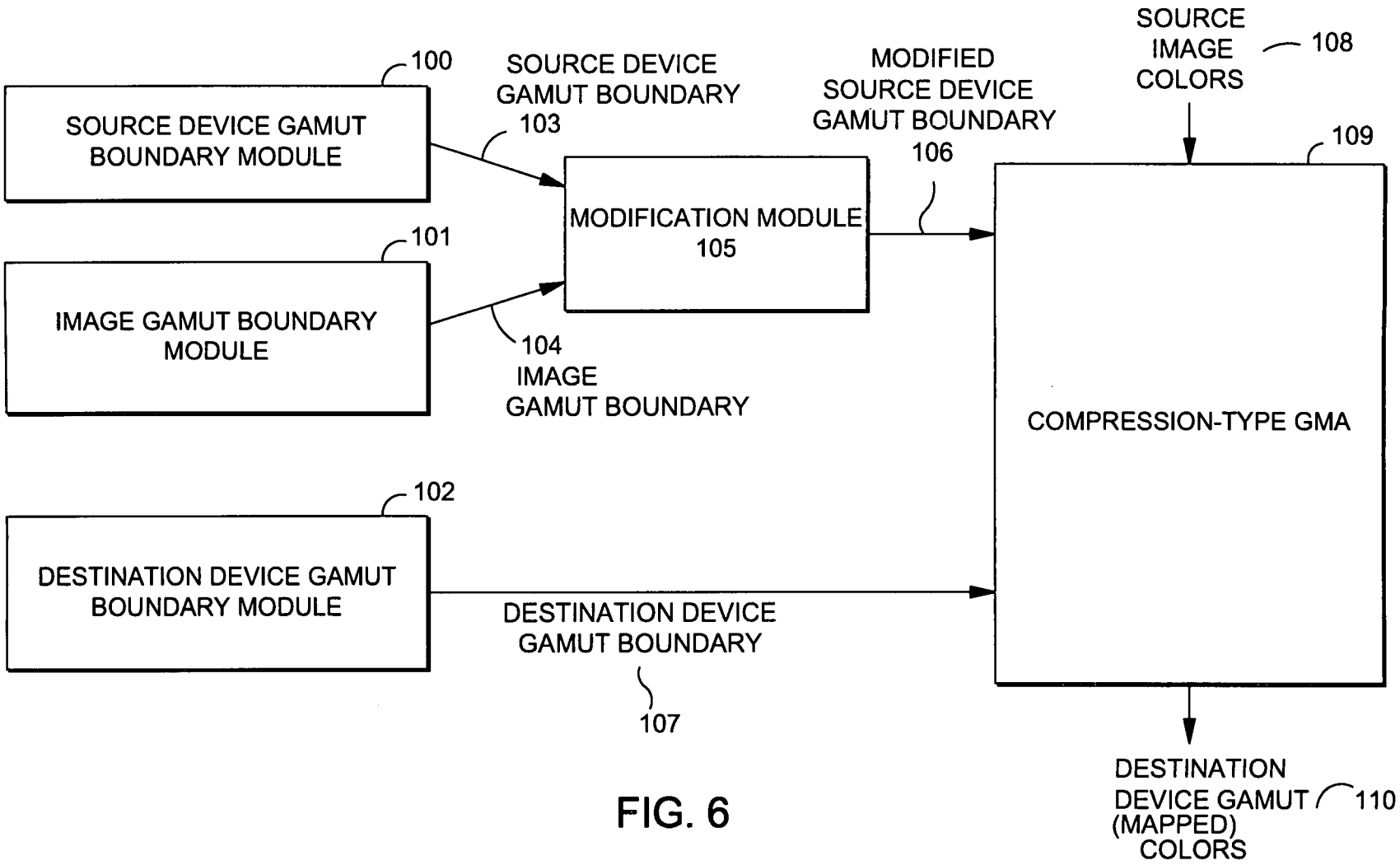
FIG. 6 is a view for explaining the software architecture of a gamut mapping module using a compression-type GMA and a modified source device gamut boundary according to an example embodiment.

FIG. 6 is a view for explaining the software architecture of gamut mapping module 172 in more detail. As shown in FIG. 6, source device gamut boundary module 100 creates source device gamut boundary 103 for a source device using source device module 166 and color appearance module 169. A source device gamut represents a sampling of all possible colors that can be reproduced by the source device. Source device gamut boundary module 100 uses source device module 166 to generate values of the source device gamut in device independent color space 163. Source device gamut values in device independent color space 163 are then converted into device independent color appearance space 164 (e.g., in the CIECAM02 JCh color appearance space) by color appearance module 169, which uses source device viewing conditions obtained from a CAMP to perform conversion. Source device gamut boundary module 100 then uses the device independent appearance values produced by color appearance module 169 to generate source device gamut boundary 103.

Likewise, destination device gamut boundary module 102 creates destination device gamut boundary 107 for a destination device using destination device module 179 and color appearance module 177. A destination device gamut represents a sampling of all possible colors that can be reproduced by the destination device. Destination device gamut boundary module 102 uses destination device module 179 to generate values of the destination device gamut in device independent color space 163. Destination device gamut values in device independent color space 163 are then converted into device independent color appearance space 164 (e.g., in the CIECAM02 JCh color appearance space) by color appearance module 177, which uses destination device viewing conditions obtained from a CAMP to perform conversion. Destination device gamut boundary module 102 then uses the device independent appearance values produced by color appearance module 177 to generate destination device gamut boundary 107.

Image gamut boundary module 101 creates image gamut boundary 104 for device independent source image colors 108 which are in device independent color appearance space 164. An image gamut represents all source image colors 108 contained in an image. Source image colors 108 are colors of an image received from color appearance module 169. Image gamut boundary module 101 uses device independent source colors 108 to generate image gamut boundary 104.

Modification module 105 operates as a pre-process to compression-type GMA 109. In particular, before compression-type GMA 109 is invoked, modification module 105 modifies source device gamut boundary 103 by shrinking source device gamut boundary 103 to create modified source device gamut boundary 106. Modification module 105 shrinks source device gamut boundary 103 using the image gamut boundary 104 as a reference. Specifically, modification module 105 shrinks source device gamut boundary 103 until any part of the modified source device gamut boundary touches image gamut boundary 104. Compression-type GMA 109 then uses modified source device gamut boundary 106 and destination device gamut boundary 107 to convert device independent source image colors 108 to destination device gamut colors 110 in the device independent color appearance space 164. Destination device gamut colors 110 are device independent colors within the gamut of the destination device.

Although the architecture shown in FIG. 6 has been described herein as a part of gamut mapping module 172, it should be appreciated that the process can also be performed in other modules.

Figure 7:
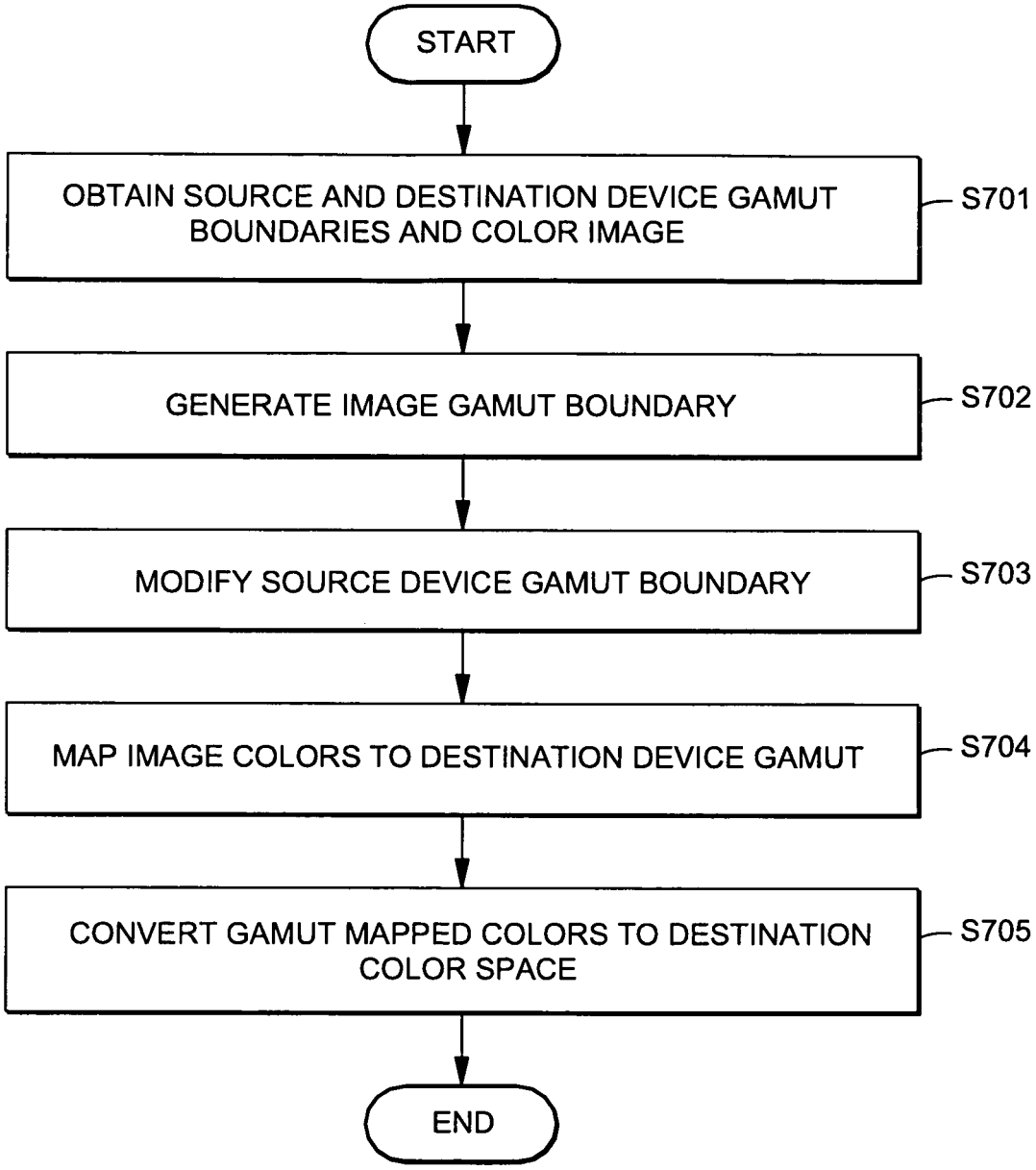
FIG. 7 is a flow diagram for explaining color processing in a color management module according to an example embodiment.

FIG. 7 is a flow diagram for explaining color processing in a color management module using a modified source device gamut boundary according to the first example embodiment. The process steps shown in FIG. 7 are computer-executable process steps stored on a computer-readable memory medium such as at 135 on disk 45, and are executed by CPU 113 of host computer 41, so as to implement a color management module in which a source-side color in a source device dependent color space is converted into a counterpart destination-side color in a destination device dependent color space. Briefly, according to the process steps shown in FIG. 7, a device independent source device gamut boundary for a source device and a device independent destination device gamut boundary for a destination device are obtained. A source color image in a source device dependent color space is obtained, and the source color image is transformed into a device independent image in a device independent color space. An image gamut boundary for the device independent image is generated based on the color content of the device independent image. The source device gamut boundary is modified by shrinking the source device gamut boundary in a hue symmetric manner, such that hues of colors do not change, until it touches the image gamut boundary. Colors of the device independent image are mapped onto a gamut of the destination device by invoking the compression-type GMA that uses the modified source device gamut boundary and the destination device gamut boundary to perform gamut mapping, and the gamut mapped colors are converted into destination-side colors in the destination device dependent color space.

In more detail, in step S701, modification module 105 obtains the source device gamut boundary for the source device and obtains the destination device gamut boundary for the destination device. As described above in reference to FIG. 6, the source device gamut boundary and the destination device gamut boundary are represented in device independent color appearance space 164. In addition, in step S701, the source color image consisting of source image colors 108 in device independent color appearance space 164 is obtained.

In step S702, an image gamut boundary is generated based on the color content of device independent source image colors 108 which are received from color appearance module 169. As described above, source image colors 108 are in device independent color appearance space 164. Image gamut boundary module 101 uses device independent source image colors 108 to generate the image gamut boundary in device independent color appearance space 164.

In step S703, the device independent source device gamut boundary 103 is modified by modification module 105 to generate the modified source device gamut boundary 106. In particular, modification module 105 modifies source device gamut boundary 103 by shrinking source device gamut boundary 103 in a hue symmetric manner, such that hues of colors do not change, until any point on the modified source device gamut boundary touches any point on image gamut boundary 104. Modification of the source device gamut boundary in a hue symmetric manner is discussed in more detail below with respect to FIG. 8.

In step S704, device independent source image colors 108 are mapped to destination device gamut colors 110 in device independent color appearance space 164 by compression-type GMA 109. More specifically, colors of the device independent source image 108 are mapped onto a gamut of the destination device by invoking compression-type GMA 109 which uses modified source device gamut boundary 106 and destination device gamut boundary 107 to perform gamut mapping. The gamut mapping process of compression-type GMA 109 will be discussed in more detail below with respect to FIG. 11.

In step S705, gamut mapped colors 110 are converted into destination-side colors in destination device dependent color space 162 by CMM 135. In particular, as discussed above in reference to FIG. 5, gamut-mapped colors in device independent color appearance space 164 are mapped to counterpart colors in device independent space 163 by color appearance module 177, which transforms colors based on a CAMP. Colors in device independent color space 163 are transformed into counterpart colors in destination device dependent color space 162 by destination device module 179 using a destination device model.

Figure 8:
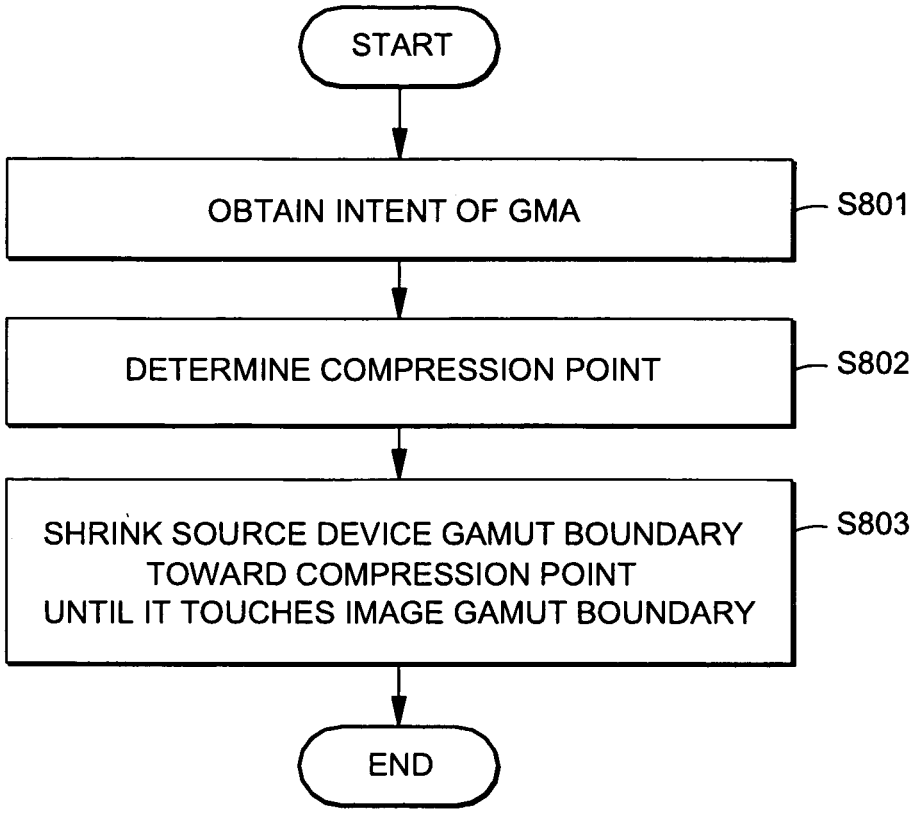
FIG. 8 is a flow diagram for explaining modifying a source device gamut boundary according to an example embodiment.

FIG. 8 is a flow diagram for explaining the modification step S703 of FIG. 7 in more detail. The process steps shown in FIG. 8 are computer-executable process steps stored on a computer-readable memory medium such as at 135 on disk 45, and are executed by CPU 113 of host computer 41, so as to modify source device gamut boundary 103. Briefly, according to the process steps shown in FIG. 8, an intent of compression-type GMA 109 is obtained, a compression point is determined based on the obtained intent of compression-type GMA 109, and the source device gamut boundary is modified by moving each point on the source device gamut boundary toward the compression point, until a point on the modified source device gamut boundary touches the image gamut boundary.

In more detail, in step S801, modification module 105 obtains the intent of compression-type GMA 109 from the corresponding GMA profile 174. Compression-type GMA 109 can perform color conversion according to various color reproduction intents which are specified in GMA profiles 174. Color reproduction intents define a desired relationship between the source and destination color values. The intent of the GMA dictates the direction and magnitude of compression. For example, the compression direction can be toward the halfway point on the lightness axis, or toward the lightness axis keeping lightness constant. Compression can also change with respect to the location of the color point to be compressed in the gamut. Additionally, GMA compression can be linear or non-linear. Modification module 105 shrinks the source device gamut boundary closely following the intent of compression-type GMA 109. In other words, modification module 105 accounts for the compression direction and the magnitude of GMA 109. For example, if the compression direction of GMA 109 is toward the halfway point on the lightness axis, then the source device gamut boundary is shrunk in that direction.

In step S802, modification module 105 determines a compression point based on the intent obtained in step S801. The compression point is a point toward which the color point to be compressed will be moved. In step S803, modification module 105 modifies the source device gamut boundary 103 by moving each point on source device gamut boundary 103 toward the compression point, until a point on the modified source device gamut boundary touches image gamut boundary 104. These steps are explained in more detail with reference to FIG. 11, below.

Figure 9:
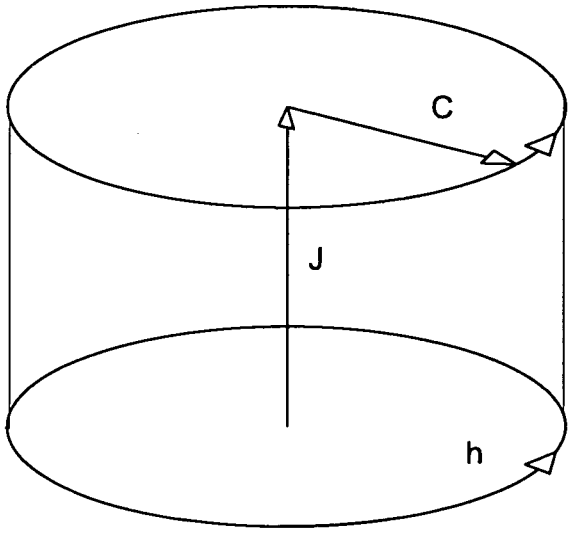
FIG. 9 is a conceptual illustration of the CIECAM02 JCh color space.

FIG. 9 is a conceptual illustration of the CIECAM02 JCh color appearance space. Color appearance space 164 is a device independent color space which accounts for viewing conditions providing by a CAMP. JCh color appearance space is an example of a device independent color appearance space 164 commonly used for gamut mapping.

JCh color space is a cylindrical space where the C axis represents chroma, the J axis represents lightness, and the angle h represents hue. Angle h is the angle from the J axis around the cylinder.

Compression-type GMA 109 operating in JCh color space normally compresses toward the J axis. For example, the compression direction can be toward the J axis keeping the J value constant, toward the midpoint of the J axis, toward the J value of a cusp point at a particular hue, or a combination of these, depending on the location of the color point to be compressed. Since compression-type GMA 109 typically performs compression in the direction of the J axis, the line of compression typically contains a constant hue. Therefore, gamut mapping can be illustrated by looking at cross-sections of the gamuts.

The example embodiments described herein are illustrated in JCh color appearance space. However, it should be appreciated that the techniques are applicable in any color space.

Figure 10:
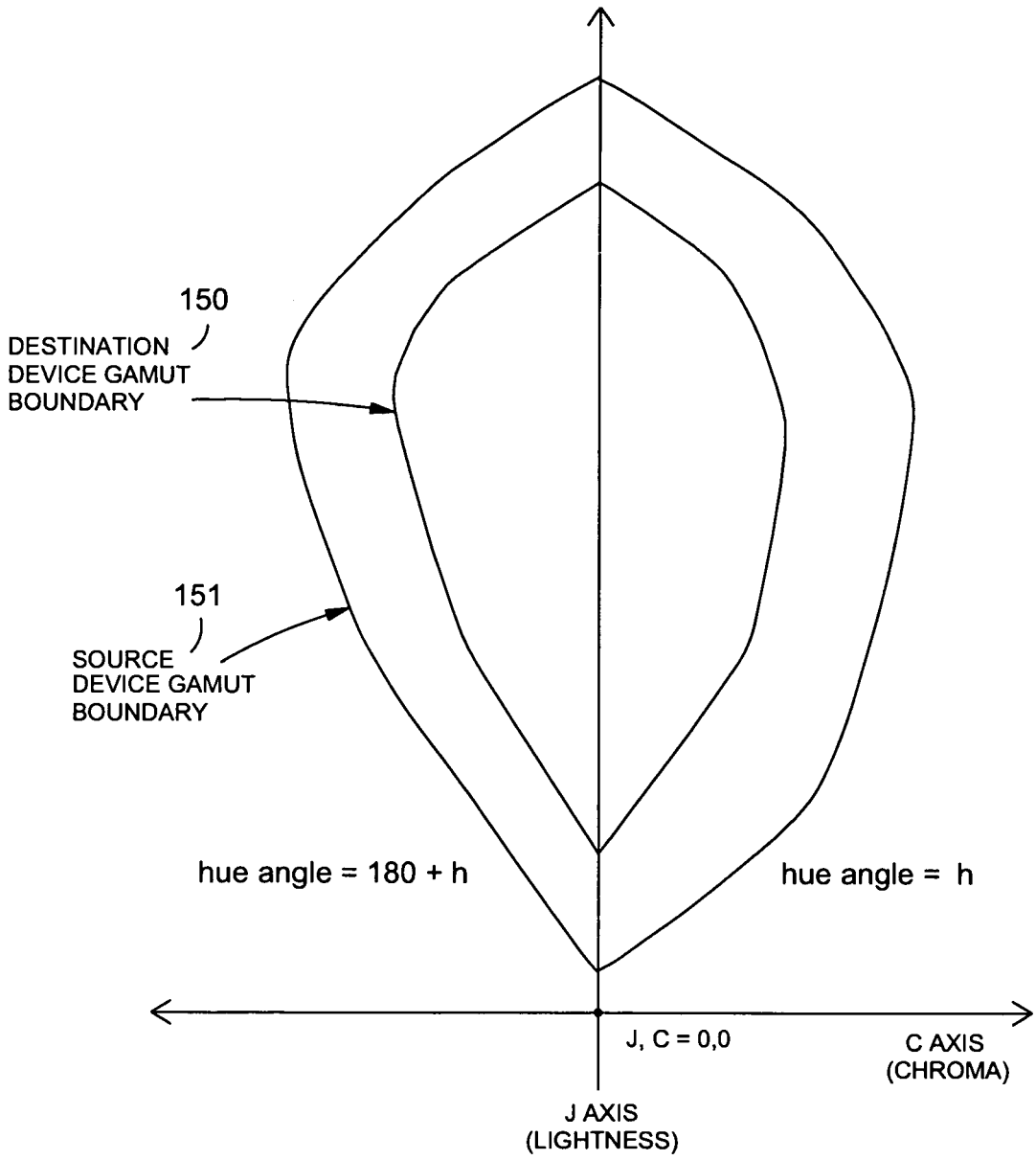
FIG. 10 depicts example source and destination device gamut boundaries.

FIG. 10 is a view illustrating source and destination device gamut boundaries in the JCh color space. As noted above, compression-type GMA 109 typically performs compression keeping angle h constant. Therefore, for the purposes of explaining gamut mapping by compression-type GMA 109, only the J axis and the C axis of the JCh color space are illustrated in FIG. 10.

Source device gamut boundary 151 is created by source device gamut boundary module 100. Source device gamut boundary 151 is the outermost perimeter of the source device gamut containing the entire range of colors capable of being reproduced by a source device. Likewise, destination device gamut boundary 150 is created by destination device gamut boundary module 102. Destination device gamut boundary 150 is the outermost perimeter of the destination device gamut containing the entire range of colors capable of reproduction by a destination device.

Figure 11:
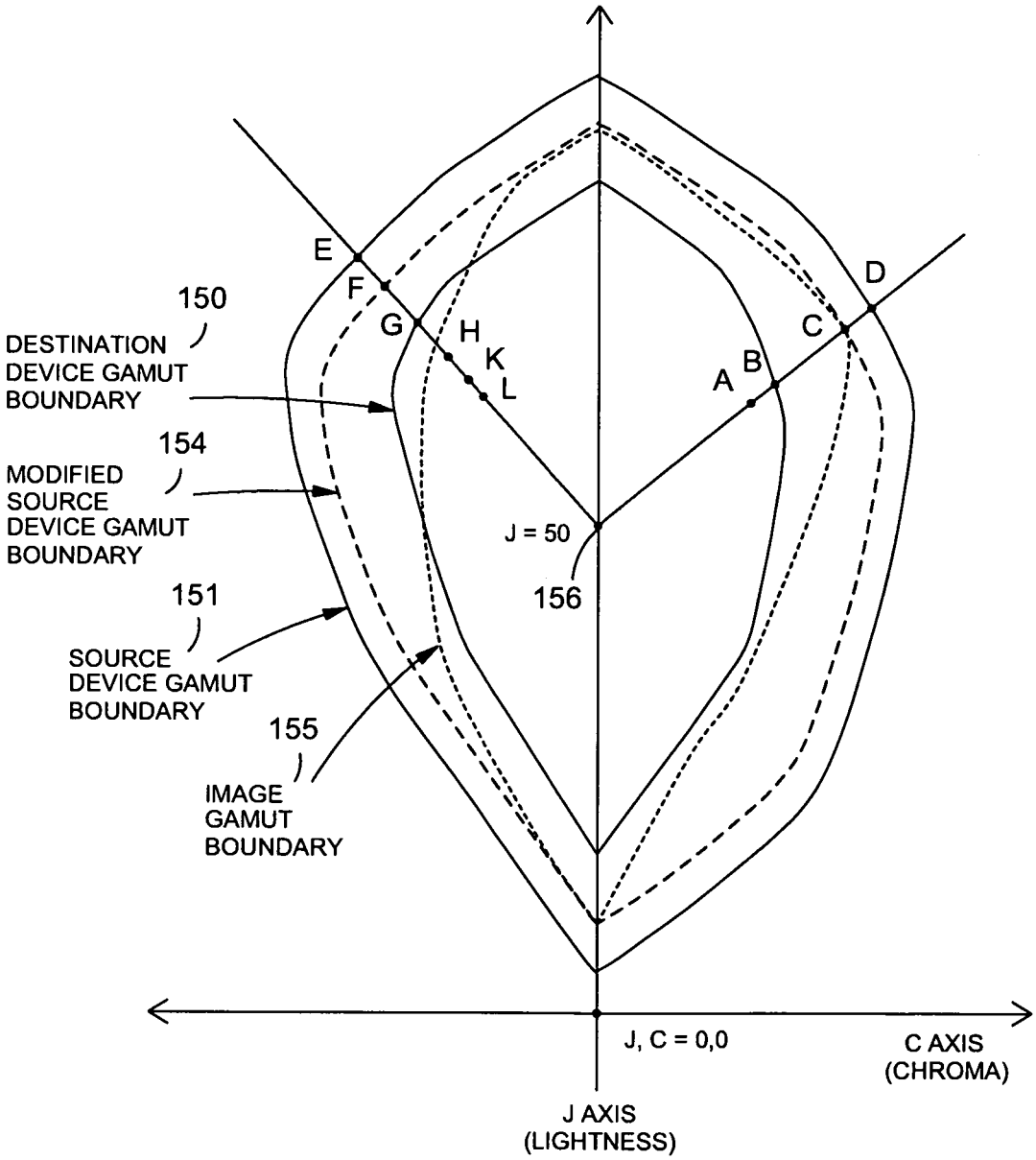
FIG. 11 is a view for explaining modification of an example source device gamut boundary and gamut mapping by a compression-type GMA according to an example embodiment.

FIG. 11 is a view for explaining modification of a source device gamut boundary and gamut mapping according to the first example embodiment. As discussed above, source device gamut boundary 151 and destination device gamut boundary 150 are created. Referring to the process steps of FIG. 7, in step S701, modification module 105 obtains source device gamut boundary 151 and destination device gamut boundary 150. A device independent source color image containing device independent source image colors 108 is also obtained in step S701. In step S702, image gamut boundary module 101 generates image gamut boundary 155. Image gamut boundary 155 is the outermost perimeter of the image gamut encompassing all of the colors contained in an image.

In step S703, modification module 105 modifies source device gamut boundary 151 to generate modified source device gamut boundary 154 by shrinking source device gamut boundary 151 in a hue symmetric manner, such that hues of colors do not change, until the modified source device gamut boundary touches image gamut boundary 155, as described above with respect to FIG. 8. Shrinking in a hue symmetric manner assumes that color hue remains constant and typically reduces the difference in compression that often occurs when one image color is more saturated than another such that image colors are preserved.

More specifically, modification module 105 obtains an intent of compression-type GMA 109 and shrinks source device gamut boundary 151 according to the intent. The intent of GMA 109 dictates the direction and magnitude of compression performed by GMA 109. Compression point 156 is determined based on the obtained intent of compression-type GMA 109. In the example illustrated by FIG. 11, compression point 156 is determined to be the point J=50 on the J axis. Modification module 105 produces modified source gamut boundary 154 by shrinking each point on source device gamut boundary 151 towards compression point 156, until a point on the source device gamut boundary touches image gamut boundary 155. Thus, source device gamut boundary 151 is shrunk symmetrically using the same compression direction as compression-type GMA 109 and preserving the relative shape of source device gamut boundary 151.

In step 704, compression-type GMA 109 performs gamut mapping using modified source gamut boundary 154 and destination device gamut boundary 150 to map the device independent source image colors to the destination device gamut.

In order to illustrate the compression process, a compression line can be envisioned from compression point 156 through a color point to be compressed, for example, color points C and H. It can then be determined where the compression line intersects modified source device gamut boundary 154 and destination device gamut boundary 150. As shown in FIG. 11, if color point C is to be compressed, the compression line from compression point 156 to color point C intersects modified source device gamut boundary 154 at point C and destination device gamut boundary 150 at point B. If color point H is to be compressed, the compression line from compression point 156 to color point H intersects modified source device gamut boundary 154 at point F and destination device gamut boundary 150 at point G. In this example, if compression-type GMA 109 uses global compression, then the new distance from the compression point to the color point to be compressed is determined by Equation 1:

$$D_{CP}=D_P*(D_D/D_S) \quad \text{(Equation 1)}$$

The color point to be compressed is moved along the compression line to this new distance, $D_{CP}$, from the compression point. In the above equation, $D_P$ represents the distance from the compression point to the color point to be compressed. $D_D$ represents the distance from the compression point to the point where the compression line intersects the destination device gamut boundary. $D_S$ represents the distance from the compression point to the point where the compression line intersects the source device gamut boundary.

For example, if the color point to be compressed is color point C, $D_P$ is equal to the distance from point C to compression point 156, $D_D$ is equal to the distance from point B to compression point 156, and $D_S$ is equal to the distance from point C to compression point 156. Using these values, the new distance of color point C from compression point 156 is calculated and color point C is moved to point B.

Similarly, if the color point to be compressed is color point H, $D_P$ is equal to the distance from point H to compression point 156, $D_D$ is equal to the distance from point G to compression point 156, and $D_S$ is equal to the distance from point F to compression point 156. Using these values, the new distance of color point H from compression point 156 is calculated and color point H is moved to point K.

Figure 12:
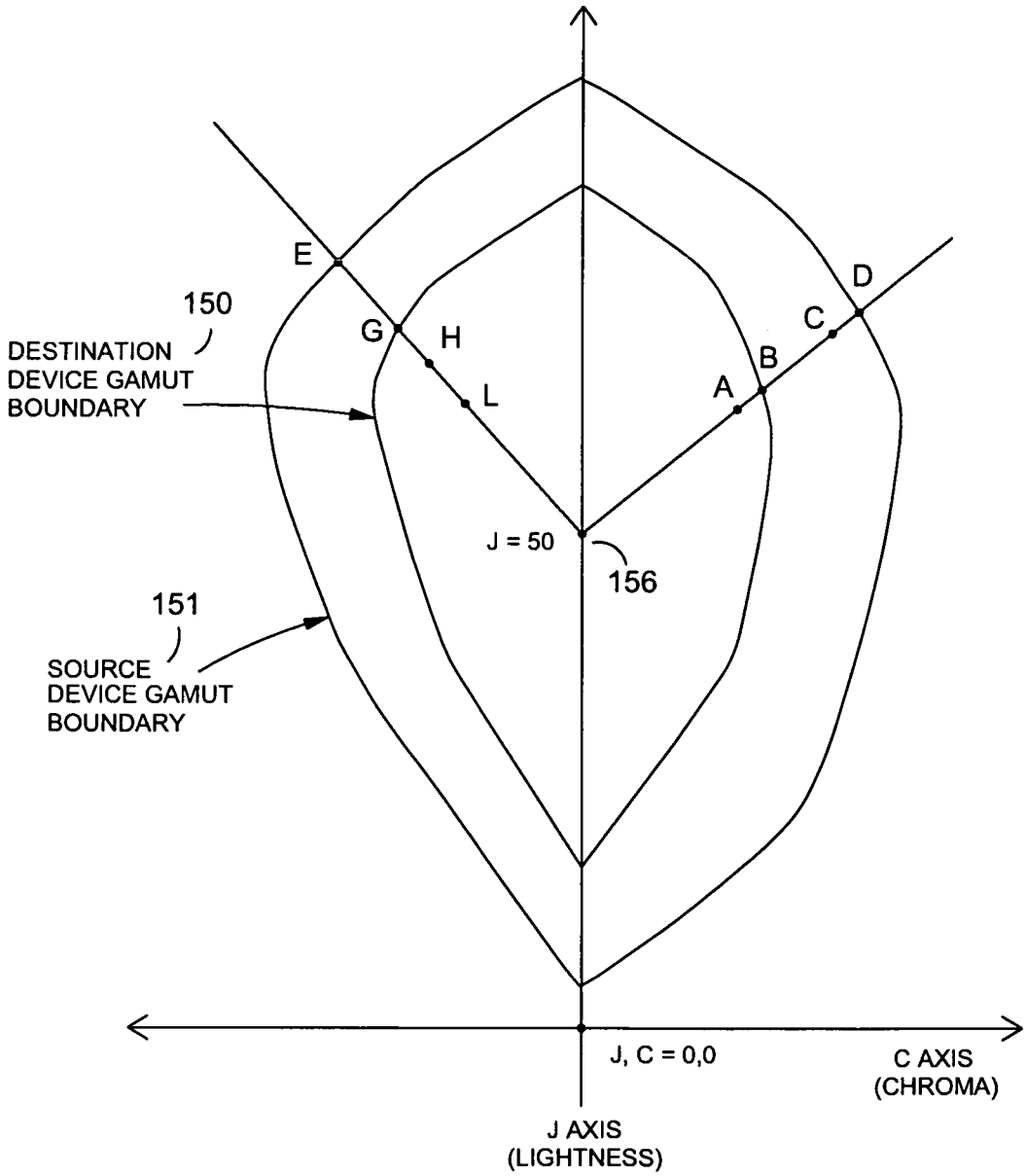
FIG. 12 is a view for explaining gamut mapping by a compression-type GMA.

FIG. 12 is a view for explaining gamut mapping by a compression-type GMA according to the first example embodiment in a case where the image gamut boundary already touches source device gamut boundary 151 before modification. In the case where the image gamut boundary already touches source device gamut boundary 151, source device gamut boundary 151 cannot be further shrunk without leaving some source image color points outside of source device gamut boundary 151. If source device gamut boundary 151 is not shrunk, or is shrunk only a little, compression-type GMA 109 would typically yield similar results to that of a standard compression-type GMA using an unmodified source device gamut boundary and a destination device gamut boundary.

For example, if source device gamut boundary 151 is not modified, then compression-type GMA 109 uses source device gamut boundary 151 and destination device gamut boundary 150 to gamut map source image colors to the destination device gamut. Thus, using equation (1) from above, if the color point to be compressed is color point C, $D_P$ is equal to the distance from point C to compression point 156, $D_D$ is equal to the distance from point B to compression point 156, and $D_S$ is equal to the distance from point D to compression point 156. Using these values, the new distance of color point C from compression point 156 is calculated and color point C is moved to point A. In contrast, as shown in FIG. 11, if compression-type GMA 109 uses modified source device gamut boundary 154 to affect gamut mapping, color point C is compressed to point B rather than point A. Therefore, the mapping performed in FIG. 11 using modified source device gamut boundary 154 results in less movement of color point C, which improves preservation of color saturation and which increases accuracy in color reproduction.

Similarly, if the color point to be compressed is color point H, $D_P$ is equal to the distance from point H to compression point 156, $D_D$ is equal to the distance from point G to compression point 156, and $D_S$ is equal to the distance from point E to compression point 156. Using these values, the new distance of color point H from compression point 156 is calculated and color point H is moved to point L. In contrast, as shown in FIG. 11, if compression-type GMA 109 uses modified source device gamut boundary 154 to affect gamut mapping, color point H is compressed to point K rather than point L. Therefore, the mapping performed in FIG. 11 using modified source device gamut boundary 154 results in less movement of color point H, which improves preservation of color saturation and which increases accuracy in color reproduction.

Thus, in many cases, shrinking of the source device gamut boundary typically reduces the overall compression of colors during gamut mapping. Additionally, because the source device gamut boundary is shrunk symmetrically, modifying the source device gamut boundary typically does no harm to the difference in compression between various color points during gamut mapping. Furthermore, in the case that the source device gamut boundary is not modified, or is modified by only a small amount, the compression-type GMA typically yields similar results to that of a standard compression-type GMA which uses an unmodified source device gamut boundary. Thus, the compression-type GMA typically does no harm to the amount of overall color compression in comparison to a standard GMA using an unmodified source device gamut boundary.

Second Embodiment

Figure 13:
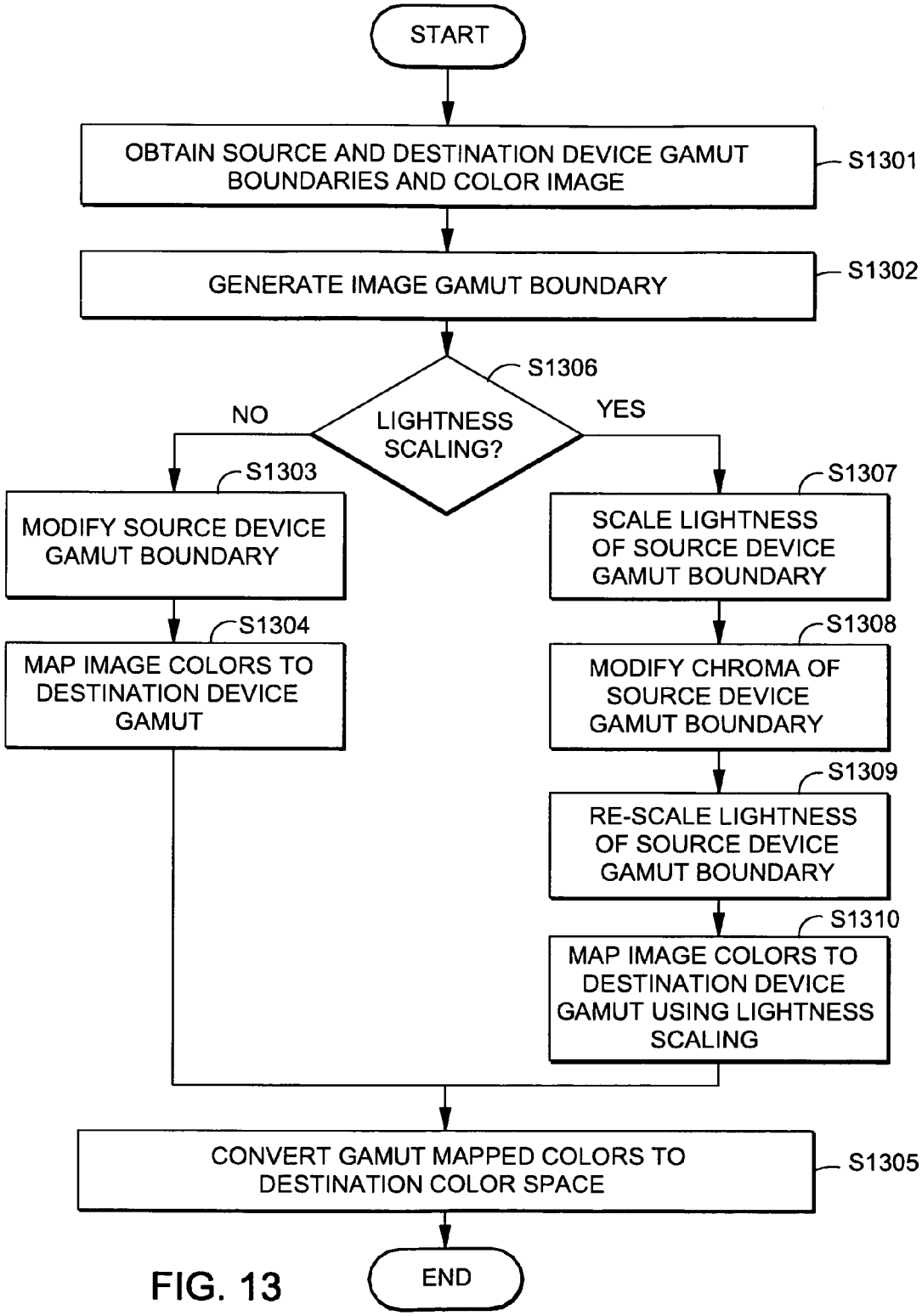
FIG. 13 is a flow diagram for explaining color processing in a color management module using a lightness-scaling compression-type GMA according to an example embodiment.

FIG. 13 is a flow diagram for explaining color processing in a color management module using a lightness-scaling compression-type GMA according to a second example embodiment. The process steps shown in FIG. 13 are computer-executable process steps stored on a computer-readable memory medium, and executed by a CPU of a host computer similar to the host computer 41 described above with respect to FIG. 3, so as to implement a color management module similar to CMM 135, described above with respect to FIG. 5, in which a source-side color in a source device dependent color space is converted into a counterpart destination-side color in a destination device dependent color space.

The color management module includes a source device module similar to source device module 166 of FIG. 5, color appearance modules similar to color appearance module 169 and color appearance module 177 of FIG. 5, and a destination device module similar to destination device module 179 of FIG. 5. The color management module also includes a gamut mapping module. In the second embodiment, the gamut mapping module implements a compression-type GMA which performs lightness-scaling before compression. The gamut mapping module reconciles the differences in the gamut of colors reproducible by the source device as against the gamut of colors reproducible by the destination device. The gamut mapping module includes a source device gamut boundary module similar to source device gamut boundary module 100 of FIG. 6, an image gamut boundary module similar to image gamut boundary module 101 of FIG. 6, a destination device gamut boundary module similar to destination device gamut boundary module 102 of FIG. 6. The gamut mapping module also includes a modification module. In the second embodiment, the modification module modifies the source device gamut boundary, taking into account the lightness-scaling performed by the compression-type GMA.

According to the process steps shown in FIG. 13, a device independent source device gamut boundary for a source device and a device independent destination device gamut boundary for a destination device are obtained. A source color image in a source device dependent color space is obtained. The source color image is transformed into a device independent image in a device independent color space and an image gamut boundary for the device independent image is generated based on the color content of the device independent image. Responsive to a determination that the compression-type GMA does not perform lightness scaling, the source device gamut boundary is modified by shrinking the source device gamut boundary in a hue symmetric manner, such that hues of colors do not change, until it touches the image gamut boundary. Colors of the device independent image are mapped onto a gamut of the destination device by invoking the compression-type GMA that uses the modified source device gamut boundary and the destination device gamut boundary to perform gamut mapping, and the gamut mapped colors are converted into destination-side colors in the destination device dependent color space. On the other hand, responsive to a determination that the compression-type GMA performs lightness scaling, a lightness of the source device gamut boundary is scaled so that maximum and minimum values of the lightness of the source device gamut boundary match maximum and minimum values of a lightness of the destination device gamut boundary. The lightness-scaled source device gamut boundary is shrunk such that only chroma components of the source device gamut boundary are modified, the modified lightness-scaled source device gamut boundary is re-scaled to an original lightness, and the re-scaled and modified source device gamut boundary is used by the lightness-scaling compression-type GMA.

In more detail, in step S1301, the source device gamut boundary for a source device is obtained, and the destination device gamut boundary for a destination device is obtained, through processes similar to those described above in reference to FIG. 6. The source device gamut boundary and the destination device gamut boundary are in a device independent color appearance space (e.g., CIECAM02 JCh color space). In addition, in step S1301, a source color image consisting of device independent source image colors in the device independent color appearance space is obtained from a color appearance module, similar to color appearance module 169 of FIG. 5.

In step S1302, an image gamut boundary is generated based on the color content of the device independent source image colors, through processes similar to those described above in reference to FIG. 6.

In step S1306 is it determined whether the compression-type GMA performs lightness scaling. A gamut mapping profile includes information regarding lightness-scaling, and the determination is made by analyzing the gamut mapping profile associated with the compression-type GMA. Many compression-type GMAs that use source and destination device gamut boundaries perform lightness scaling on the source device gamut boundary to match the lightness range of the destination device gamut boundary before compressing image colors. Compression-type GMAs can also perform lightness scaling on the source color image color points to match a lightness of the source device gamut boundary.

If it is determined in step S1306 that the compression-type GMA performs lightness scaling ("YES" at step S1306), processing proceeds to step S1307. In step S1307, a lightness of the source device gamut boundary is pre-compressed to match the range of the destination device gamut boundary. In particular, the lightness of source device gamut boundary is scaled so that maximum and minimum values of the lightness of the source device gamut boundary match maximum and minimum values of a lightness of the destination device gamut boundary. The same lightness scaling factor is also applied to the image gamut boundary. This process is described below in more detail with respect to FIG. 14.

In step S1308, the chroma components of the source device gamut boundary are modified. In particular, if the lightness-scaled source device gamut boundary is in a color space having at least a coordinate representing lightness and a coordinate representing chroma, the lightness-scaled source device gamut boundary is modified by moving a chroma component of each point on the lightness-scaled source device gamut boundary incrementally toward an axis representing the lightness coordinate, until any point on the modified source device gamut boundary touches any point on the image gamut boundary which is not on the lightness coordinate axis. Modification of the chroma components of the lightness-scaled source device gamut boundary is performed in a hue symmetric manner, keeping lightness constant. Shrinking in a hue symmetric manner assumes that color hue remains constant and typically reduces the difference in compression that often occurs when one image color is more saturated than another, such that image colors are preserved.

In the second embodiment, the compression direction of the lightness-scaled source device gamut boundary may not exactly match the intent of the compression-type GMA, but the average compression direction for all points on the lightness-scaled source device gamut boundary may still be true to the GMA's intent and over-compression may still be minimized. The direction in which the lightness-scaled source device gamut boundary is compressed will ordinarily match the intent of the compression-type GMA if the intent of the compression-type GMA preserves lightness, i.e. performs chroma-only compression.

In step S1309, the modified lightness-scaled source device gamut boundary is re-scaled to the original lightness maximum and minimum of the source device gamut boundary. This re-scaling step is performed in order to prepare the modified lightness-scaled source device gamut boundary for use by the lightness scaling compression-type GMA, since this GMA will perform lightness scaling on its own. After the GMA performs lightness scaling on the re-scaled source device gamut boundary, it will use the modified lightness-scaled source device gamut boundary in order to affect gamut mapping in step S1310.

In step S1310, the device independent source image colors obtained in step S1301 are mapped to destination device gamut colors by the compression-type GMA using the re-scaled source device gamut boundary and the destination device gamut boundary. The compression-type GMA performs lightness scaling before compression, as determined in step S1306. The gamut mapping process of a lightness scaling compression-type GMA is described in more detail below with respect to FIG. 16.

In step S1305, the gamut mapped colors are converted to colors in a destination device dependent color space. Through a process similar to that described above in reference to FIG. 5, gamut-mapped colors which are in a device independent color appearance space are mapped to counterpart colors in a device independent space. The colors in the device independent color space are transformed into counterpart colors in the destination device dependent color space using a destination device model of the destination device.

On the other hand, if it is determined in step S1306 that the compression-type GMA does not perform lightness scaling ("NO" at step S1306), then processing proceeds to step S1303. In step S1303, the source device gamut boundary is modified to generate the modified source device gamut boundary. In particular, the source device gamut boundary is modified by shrinking the source device gamut boundary in a hue symmetric manner, such that hues of colors do not change, until any point on the modified source device gamut boundary touches any point on the image gamut boundary.

In step S1304, the device independent source image colors obtained in step S1301 are mapped to destination device gamut colors in a device independent color appearance space by the compression-type GMA which, as determined in step S1306, does not perform lightness scaling. More specifically, the device independent source image colors are mapped onto a gamut of the destination device by invoking the compression-type GMA which uses the modified source device gamut boundary and the destination device gamut boundary to perform gamut mapping. After gamut mapping is completed in step S1304, the processing proceeds to step S1305 to convert the gamut mapped colors to corresponding colors in a destination device dependent color space.

Figure 14:
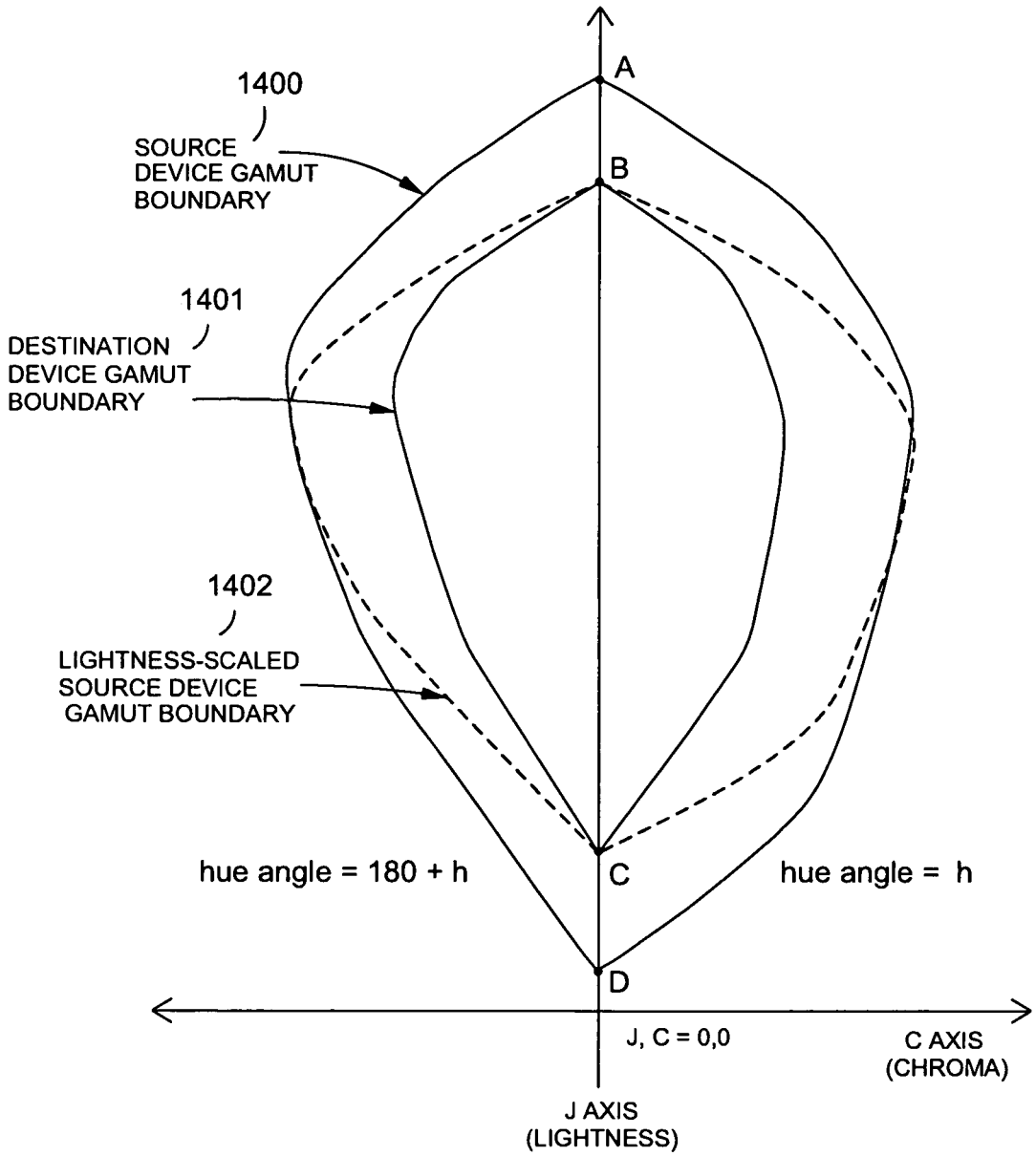
FIG. 14 is a view for explaining lightness-scaling of a source device gamut boundary according to an example embodiment.

FIG. 14 is a view for explaining the lightness-scaling step S1307 of FIG. 13 in more detail. In the second embodiment gamut mapping is performed in the JCh color appearance space. Therefore, FIG. 14 depicts colors in the JCh color space. Since lightness-scaling compression-type GMAs typically keep hue angle h constant when performing lightness scaling, for the purpose of explaining lightness scaling, only the J axis and the C axis of the JCh color space are illustrated in FIG. 14.

Example source device gamut boundary 1400 represents the outermost perimeter of the source device gamut containing the entire range of colors capable of being reproduced by a source device. Example destination device gamut boundary 1401 represents the outermost perimeter of the destination device gamut containing the entire range of colors capable of being reproduced by a destination device. Referring to the process steps in FIG. 13, in step S1301, source device gamut boundary 1400 and destination device gamut boundary 1401 are obtained. The lightness of source device gamut boundary 1400 is represented by the J axis and the chroma of source device gamut boundary 1400 is represented by the C axis.

In step S1307 of FIG. 13, the lightness components of source device gamut boundary 1400 are scaled along the J axis so that the maximum and minimum lightness values of source device gamut boundary 1400 match the maximum and minimum values of destination device gamut boundary 1401. Thus, the maximum lightness value for source device gamut boundary 1400, which is point A on the J axis, is scaled to the maximum lightness value for destination device gamut boundary 1401, which is point B on the J axis. Similarly, the minimum lightness value for source device gamut boundary 1400, which is point D on the J axis, is scaled to the minimum lightness value for destination device gamut boundary 1401, which is point C on the J axis. As shown in FIG. 14, this results in lightness-scaled source device gamut boundary 1402. Lightness-scaled source device gamut boundary 1402 is then modified in step S1308 of FIG. 13.

Figure 15:
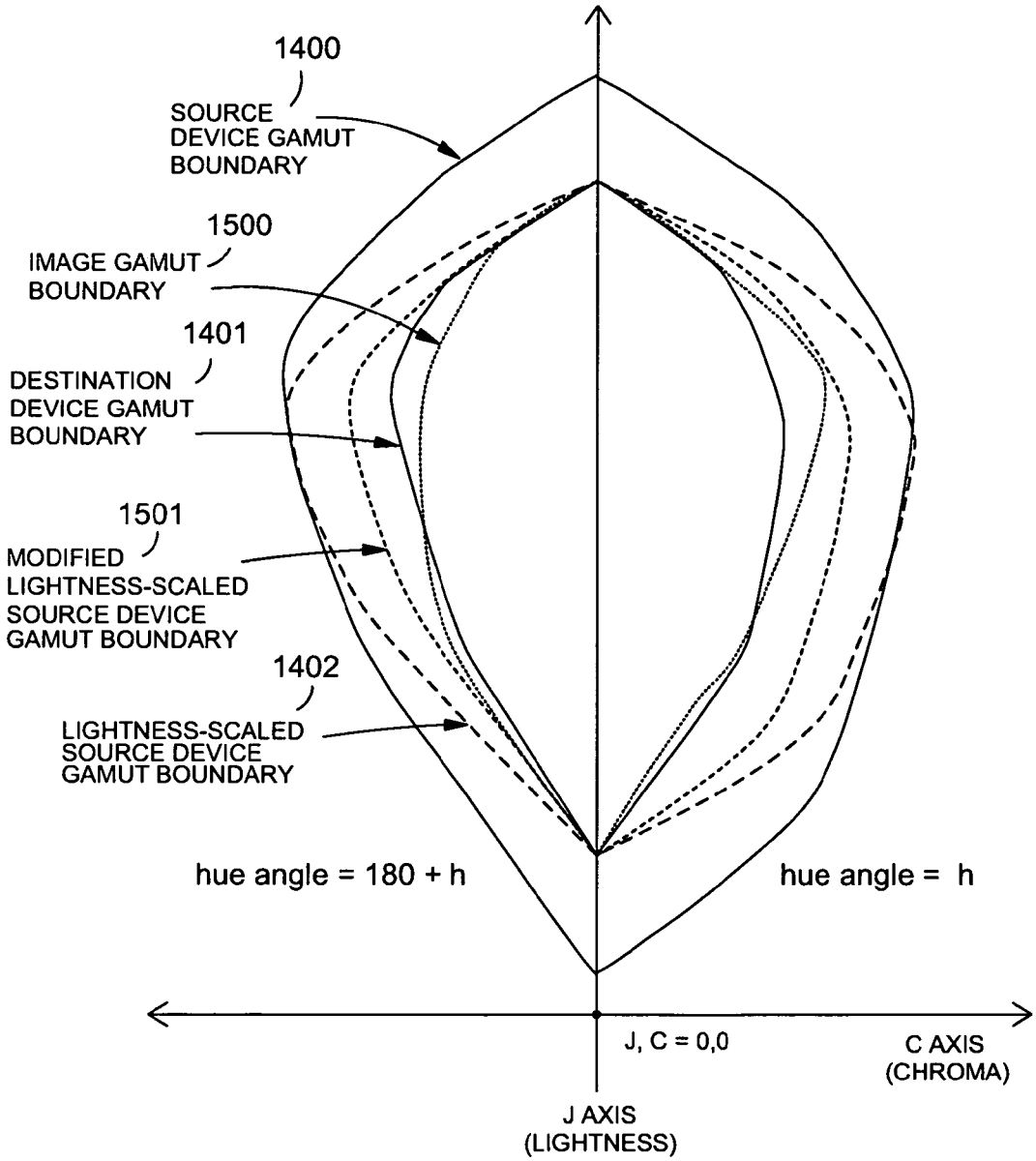
FIG. 15 is a view for explaining modification of a lightness-scaled source device gamut boundary after lightness-scaling according to an example embodiment.

FIG. 15 is a view for explaining modifying step S1308 of FIG. 13 in more detail. Image gamut boundary 1500 is generated in step S1302 of FIG. 13 and is the outermost perimeter of the image gamut encompassing all of the colors contained in an image. In step S1308, lightness-scaled source device gamut boundary 1402 is modified by moving the chroma components, represented by the C axis, of each point on lightness-scaled source device gamut boundary 1402 incrementally and hue symmetrically toward the J axis representing lightness, until a point on the lightness-scaled source device gamut boundary touches a point on image gamut boundary 1500 which does not lie on the J axis. This results in modified lightness-scaled source device gamut boundary 1501, which is re-scaled to the original lightness of source device gamut boundary 1400 (in step S1309) and then provided to the lightness scaling compression-type GMA to perform gamut mapping (in step S1310).

Figure 16:
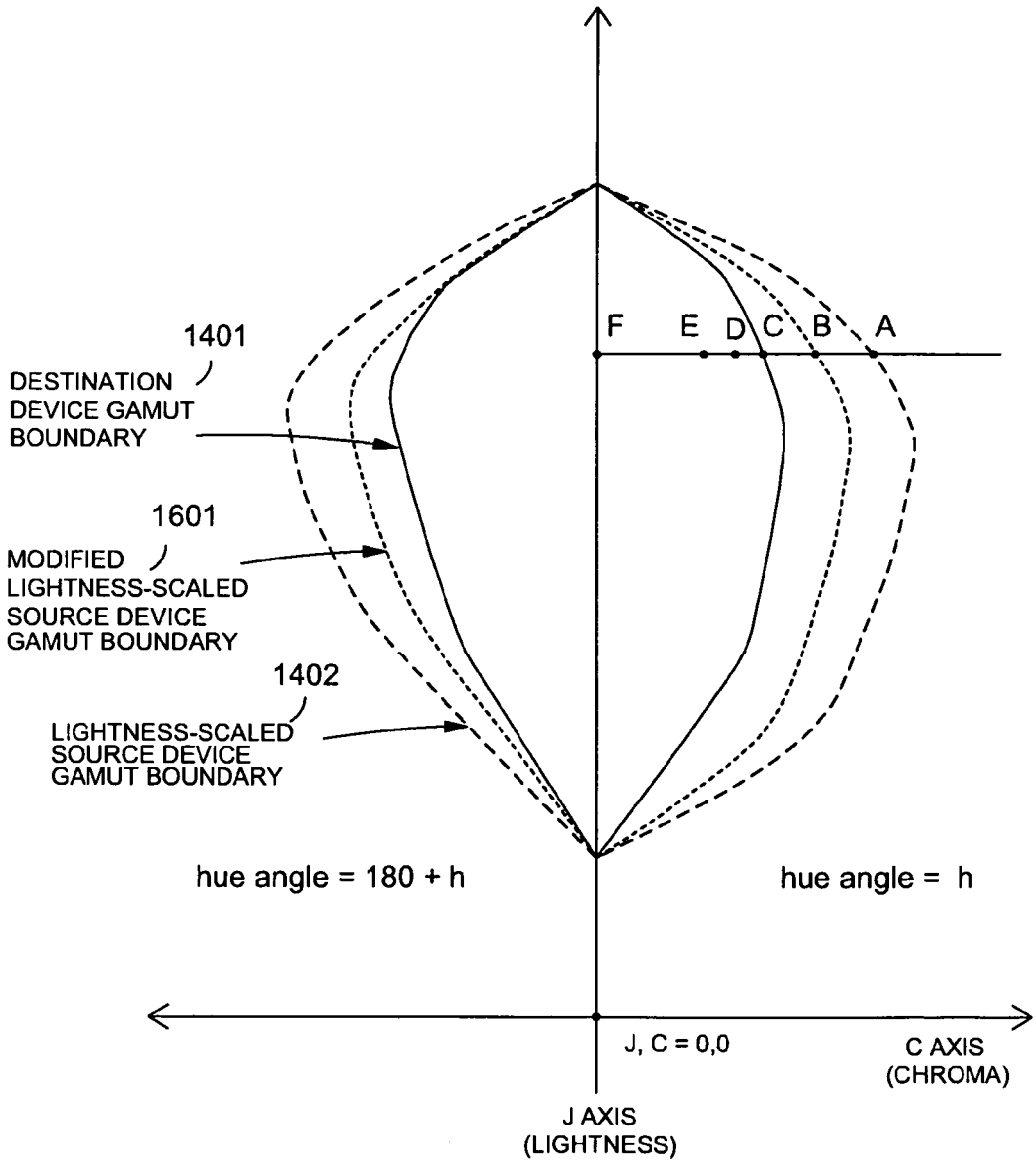
FIG. 16 is a view for explaining gamut mapping by a lightness-scaling compression-type GMA.

FIG. 16 is a view for explaining gamut mapping step S1310 of FIG. 13 performed by a compression-type GMA using the re-scaled source device gamut boundary according to the second example embodiment. When the re-scaled source device gamut boundary is passed to the lightness-scaling compression-type GMA, the GMA first scales the maximum and minimum lightness values of the re-scaled source device gamut boundary to match the maximum and minimum lightness values of destination device gamut boundary 1401 before performing gamut mapping. This results in modified lightness-scaled source device gamut boundary 1601. The device independent source image color points are also lightness-scaled in this manner.

The GMA then compresses each color point toward the J axis, keeping the J value constant. Thus, the performed compression is lightness and hue preserving. In order to illustrate the compression process, a compression line can be envisioned from a color point to be compressed to the J axis, keeping the J value constant. The hue value is also kept constant. To illustrate, if it is assumed that the color point to be compressed is at a point ($J_0$, $C_0$, $h_0$), then the corresponding compression line extends from ($J_0$, $C_0$, $h_0$) to the point ($J_0$, 0, 0) on the J axis. For example, if the color point to be compressed is color point B in FIG. 16, then the compression line extends from point F on the J axis through color point B. The compression line intersects destination device gamut boundary 1401 at a point ($J_0$, $C_d$, $h_0$) and intersects modified lightness-scaled source device gamut boundary 1601 at a point ($J_0$, $C_s$, $h_0$). Continuing with the previous example, if the color point to be compressed is color point B, the compression line intersects destination device gamut boundary 1401 at point C and intersects modified lightness-scaled source device gamut boundary 1601 at point B. The GMA proportionally compresses a color point on the line segment extending from point ($J_0$, 0, 0) to point ($J_0$, $C_s$, $h_0$) to a color point on the line segment extending from point ($J_0$, 0, 0) to point ($J_0$, $C_d$, $h_0$), so that the mapped color point will be on or within destination device gamut boundary 1401. Thus, if the color point to be compressed is color point B, the GMA will move point B on the line segment BF to a color point on the line segment CF. Thus, the mapped location of the color point to be compressed is ($J_1$, $C_1$, $h_1$), where $J_1$, $C_1$ and $h_1$ are defined by the following equations:

$$J_1=J_0 \quad \text{(Equation 2)}$$

$$C_1=C_0\times(C_d\div C_s) \quad \text{(Equation 3)}$$

$$h_1=h_0 \quad \text{(Equation 4)}$$

This compression will cause each color point that lies on modified lightness-scaled source device gamut boundary 1601 to map to a corresponding color point on destination device gamut boundary 1401. Therefore, all color points that were originally contained within the source device gamut will be mapped into the destination device gamut. Thus, if the color point to be compressed is color point B, the distance from the J axis to color point B is represented by the line segment from point F to point B. The distance from the J axis to destination device gamut boundary 1401 is represented by the line segment from point F to point C. The distance from the J axis to modified lightness-scaled source device gamut boundary 1601 is represented by the line segment from point F to point B. Using these values and equations (2) through (4) above, color point B will map to point C.

Similarly, if the color point to be compressed is color point C, then the compression line extends from point F through color point C. The distance from the J axis to color point C is represented by the line segment from point F to point C. The distance from the J axis to destination device gamut boundary 1401 is represented by the line segment from point F to point C. The distance from the J axis to modified lightness-scaled source device gamut boundary 1601 is represented by the line segment from point F to point B. Using these values and equations (2) through (4) above, color point C will map to point D.

On the other hand, as also shown in FIG. 16, if the chroma components of lightness-scaled source device gamut boundary 1402 have not been shrunk, then the compression-type GMA will calculate compression values using lightness-scaled source device gamut boundary 1402. In this case, if the color point to be compressed is color point B, the distance from the J axis to color point B is represented by the line segment from point F to point B. The distance from the J axis to destination device gamut boundary 1401 is represented by the line segment from point F to point C. The distance from the J axis to lightness-scaled source device gamut boundary 1402 is represented by the line segment from point F to point A. Using these values and equations (2) through (4) above, color point B will map to point D rather than point C.

Similarly, if the color point to be compressed is color point C and if the chroma components of lightness-scaled source device gamut boundary 1402 have not been shrunk, then the distance from the J axis to color point C is represented by the line segment from point F to point C. The distance from the J axis to destination device gamut boundary 1401 is represented by the line segment from point F to point C. The distance from the J axis to lightness-scaled source device gamut boundary 1402 is represented by the line segment from point F to point A. Using these values and equations (2) through (4) above, color point C will map to point E rather than point D.

Therefore, as shown using the example gamut boundaries depicted in FIG. 16, when the lightness-scaling compression-type GMA uses modified source device gamut boundary 1501, the amount of movement of each color point during compression is minimized.

Occasionally, due to arithmetic precision error or other error, some color points will remain outside destination device gamut boundary 1401 after gamut mapping. Therefore, the GMA will typically ensure that no color points remain outside destination device gamut boundary 1401 by clipping these points directly to the nearest color point on the destination device gamut.

Third Embodiment

Figure 17:
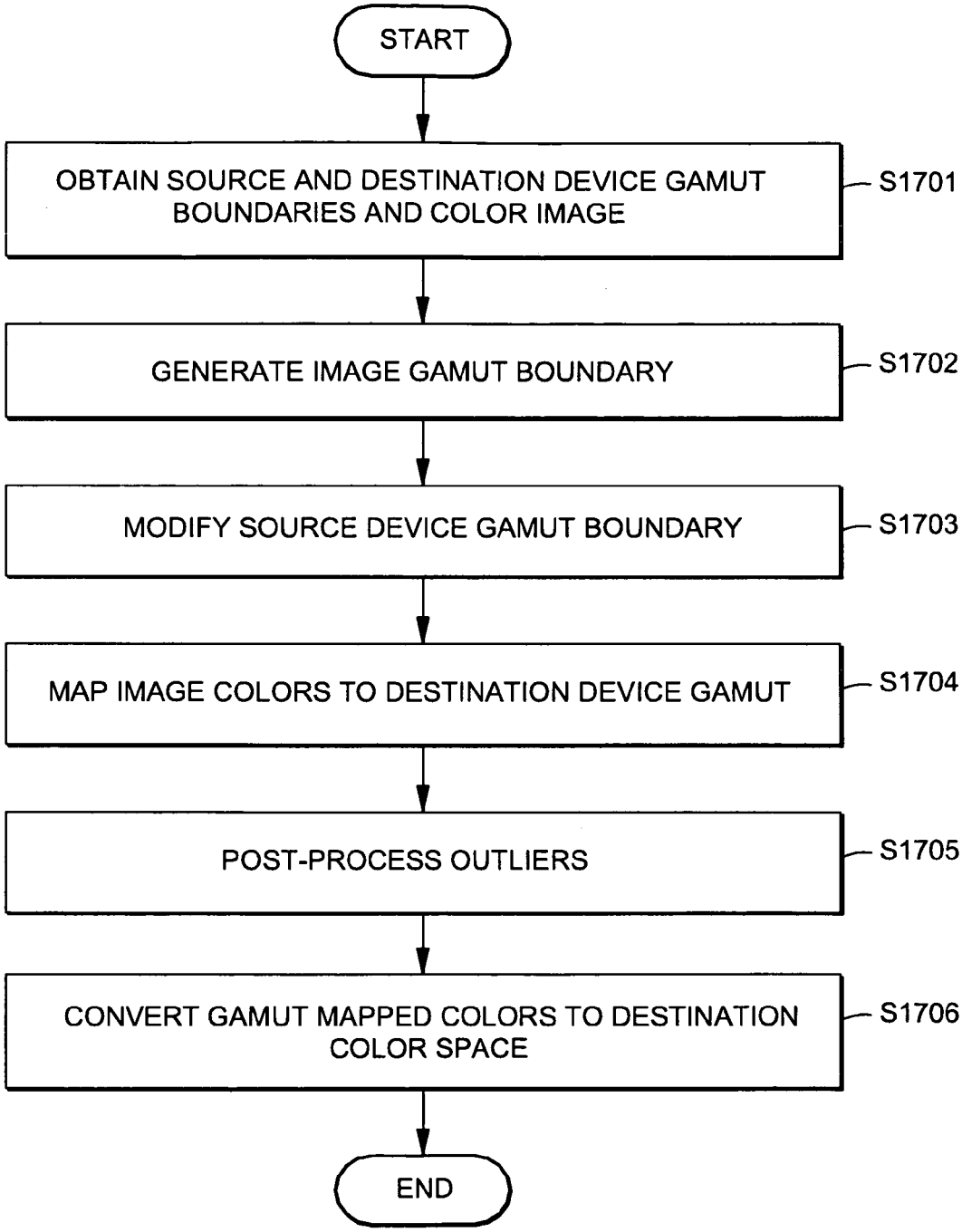
FIG. 17 is a flow diagram for explaining color processing in a color management module according to an example embodiment.

FIG. 17 is a flow diagram for explaining color processing in a color management module including a post-processing step according to a third example embodiment. The process steps shown in FIG. 17 are computer-executable process steps stored on a computer-readable memory medium, and executed by a CPU of a host computer similar to host computer 41 which is described above with respect to FIG. 3, so as to implement a color management module similar to CMM 135, which is described above with respect to FIG. 5, in which a source-side color in a source device dependent color space is converted into a counterpart destination-side color in a destination device dependent color space.

The color management module includes a source device module similar to source device module 166 of FIG. 5, color appearance modules similar to color appearance module 169 and color appearance module 177 of FIG. 5, and a destination device module similar to destination device module 179 of FIG. 5. The color management module also includes a gamut mapping module. In the third embodiment, the gamut mapping module performs a post-processing step after gamut mapping. The gamut mapping module reconciles the differences in the gamut of colors reproducible by the source device as against the gamut of colors reproducible by the destination device. The gamut mapping module includes a source device gamut boundary module similar to source device gamut boundary module 100 of FIG. 6, an image gamut boundary module similar to image gamut boundary module 101 of FIG. 6, and a destination device gamut boundary module similar to destination device gamut boundary module 102 of FIG. 6. The gamut mapping module also includes a modification module. In the third embodiment, the modification module modifies the source device gamut boundary and performs an additional modifying step to further shrink the source device gamut boundary past the image gamut boundary.

Briefly, according to the process steps shown in FIG. 17, a device independent source device gamut boundary for a source device and a device independent destination device gamut boundary for a destination device are obtained, a source color image in a source device dependent color space is obtained, the source color image is transformed into a device independent image in a device independent color space, an image gamut boundary for the device independent image is generated based on the color content of the device independent image and the source device gamut boundary is modified by shrinking the source device gamut boundary in a hue symmetric manner, such that hues of colors do not change, until it touches the image gamut boundary. The source device gamut boundary is further shrunk past the image gamut boundary, until a predetermined condition is satisfied. Colors of the device independent image are mapped onto a gamut of the destination device by invoking a compression-type GMA that uses the modified source device gamut boundary and the destination device gamut boundary to perform gamut mapping. Post-processing is performed to convert outlying color points which lie outside of the destination device gamut boundary after gamut mapping into color points that lie within the destination device gamut boundary. The gamut mapped colors are converted into destination-side colors in a destination device dependent color space.

In more detail, in step S1701, the source device gamut boundary for a source device is obtained and the destination device gamut boundary for a destination device is obtained through processes similar to those described above in reference to FIG. 6. The source device gamut boundary and the destination device gamut boundary are represented in a device independent color appearance space (e.g., CIECAM02 JCH color space). In addition, in step S1701, a source color image consisting of device independent source image colors in the device independent color appearance space is obtained from a color appearance module similar to color appearance module 169 of FIG. 5.

In step S1702, an image gamut boundary is generated based on the color content of the device independent source image colors, which are in the color appearance space, through processes similar to those described above with respect to FIG. 6.

In step S1703, the source device gamut boundary is modified to generate the modified source device gamut boundary. In particular, the source device gamut boundary is modified by shrinking the source device gamut boundary in a hue symmetric manner, such that hues of colors do not change, until any point of the modified source device gamut boundary touches any point of the image gamut boundary.

In some situations, it is advantageous to shrink the source device gamut boundary past the image gamut boundary. For example, a number of image color points at the edge of the image gamut boundary could prevent the source device gamut boundary from being shrunk more than a small amount. Also, these color points may not be crucial to the image and may occur in very small numbers. Thus, according to the third embodiment, the source device gamut boundary is additionally shrunk past the image gamut boundary leaving one or more color points of the device independent image outside of the modified source device gamut boundary. These outlying color points may lie outside of the destination device gamut boundary after the compression-type GMA performs gamut mapping. This modification step is explained in greater detail below with respect to FIG. 18.

In step S1704, the device independent source image colors obtained in step S1701 are mapped to destination device gamut colors in a device independent color appearance space by a compression-type GMA. More specifically, the device independent source image colors are mapped onto a gamut of the destination device by invoking the compression-type GMA which uses the modified source device gamut boundary and the destination device gamut boundary to perform gamut mapping.

Step S1705 is a post-processing step for converting outlying color points into color points that lie on or within the destination device gamut boundary. Outlying color points are color points that lie outside of the destination device gamut boundary after gamut mapping by the compression-type GMA. According to the third embodiment, the post-processing step S1705 involves clipping each outlying color point to a nearest color point on the destination device gamut boundary. According to another embodiment, the post-processing step S1705 maps outlying color points using a compression method, such as, for example, knee-point compression, or any other suitable type of compression process.

In step S1706, the gamut mapped colors are converted to a destination device dependent color space. Through a process similar to that described above in reference to FIG. 5, gamut-mapped colors which are in a device independent color appearance space are mapped to counterpart colors in a device independent space. The colors in device independent color space are transformed into counterpart colors in the destination device dependent color space using a destination device model of the destination device.

Figure 18:
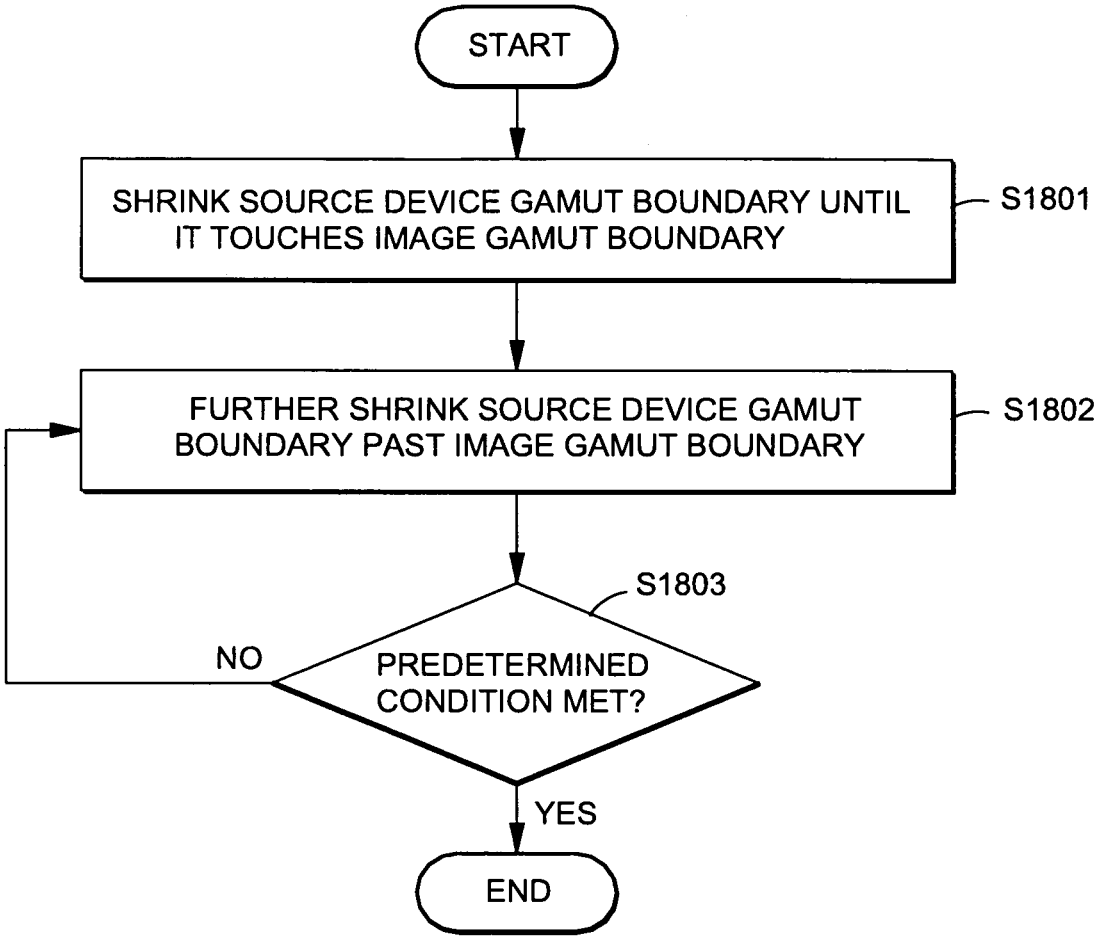
FIG. 18 is a flow diagram for explaining modification of a source device gamut boundary according to an example embodiment.

FIG. 18 is a flow diagram for explaining modification step S1703 of FIG. 17 in more detail. The process steps shown in FIG. 18 are computer-executable process steps stored on a computer-readable memory medium and executed by a CPU of a host computer similar to host computer 41 which is described above with respect to FIG. 3, so as to modify the source device gamut boundary.

Briefly, according to the process steps shown in FIG. 18, the source device gamut is shrunk until it touches the image gamut boundary and the source device gamut is further shrunk past the image gamut boundary until a predetermined condition is satisfied.

In more detail, in step S1801, the source device gamut boundary is modified by shrinking the source device gamut boundary in a hue symmetric manner, such that hues of colors do not change, until the source device gamut boundary touches the image gamut boundary.

Step S1802 is an additional shrinking step in which the source device gamut boundary is further shrunk past the image gamut boundary by a predetermined increment. The modification performed in this shrinking step is also performed in a hue symmetric manner.

In step S1803, it is determined whether a predetermined condition has been satisfied. If the predetermined condition has not been met, the process returns to step S1802 in which the source device gamut is further shrunk past the image gamut boundary by the predetermined increment. If the predetermined condition has been met, the modification of the source device gamut boundary ends.

In the third embodiment, the predetermined condition is selected by a user using a graphical user interface which provides a preview of an image resulting from the selected predetermined condition. In other embodiments, other types of user interfaces such as a command line interface or any other suitable type of user interface can be used. A user can adjust the predetermined condition and preview the result until the user is satisfied. For example, a user can examine an image histogram to estimate the overall impact of a particular condition and dynamically adjust the condition to achieve the desired result. If this previewing process is repeated on a plurality of images, a selection of parameters could be determined which results in optimal color reproduction for a majority of images.

The predetermined condition is determined based on a selection of techniques used to perform the additional shrinking step. The predetermined condition is based on parameters specified for the selected techniques, which are specified by the user via the graphical user interface. For example, a user can select a variety of techniques including a percentage technique, a threshold technique, a distance technique, a destination technique, or any other suitable technique to determine how many outlying color points would be permitted and how far from the modified source device gamut boundary they would be allowed. In particular, a percentage technique involves shrinking the modified source device gamut boundary until a specified percentage of color points of the device independent image lie outside of the modified source device gamut boundary. A threshold technique involves shrinking the modified source device gamut boundary until a specified threshold number of color points of the device independent image lie outside of the modified source device gamut boundary. A distance technique involves shrinking the modified source device gamut boundary until a distance between the modified source device gamut boundary and any color point of the device independent image that lies outside of the modified source device gamut boundary reaches a specified maximum distance. A destination technique involves shrinking the modified source device gamut boundary until the modified source device gamut boundary touches the destination device gamut boundary.

In another embodiment, the additional shrinking step S1802 and the post-processing step S1705 are selectively enabled by the user via the user interface.

Figure 19:
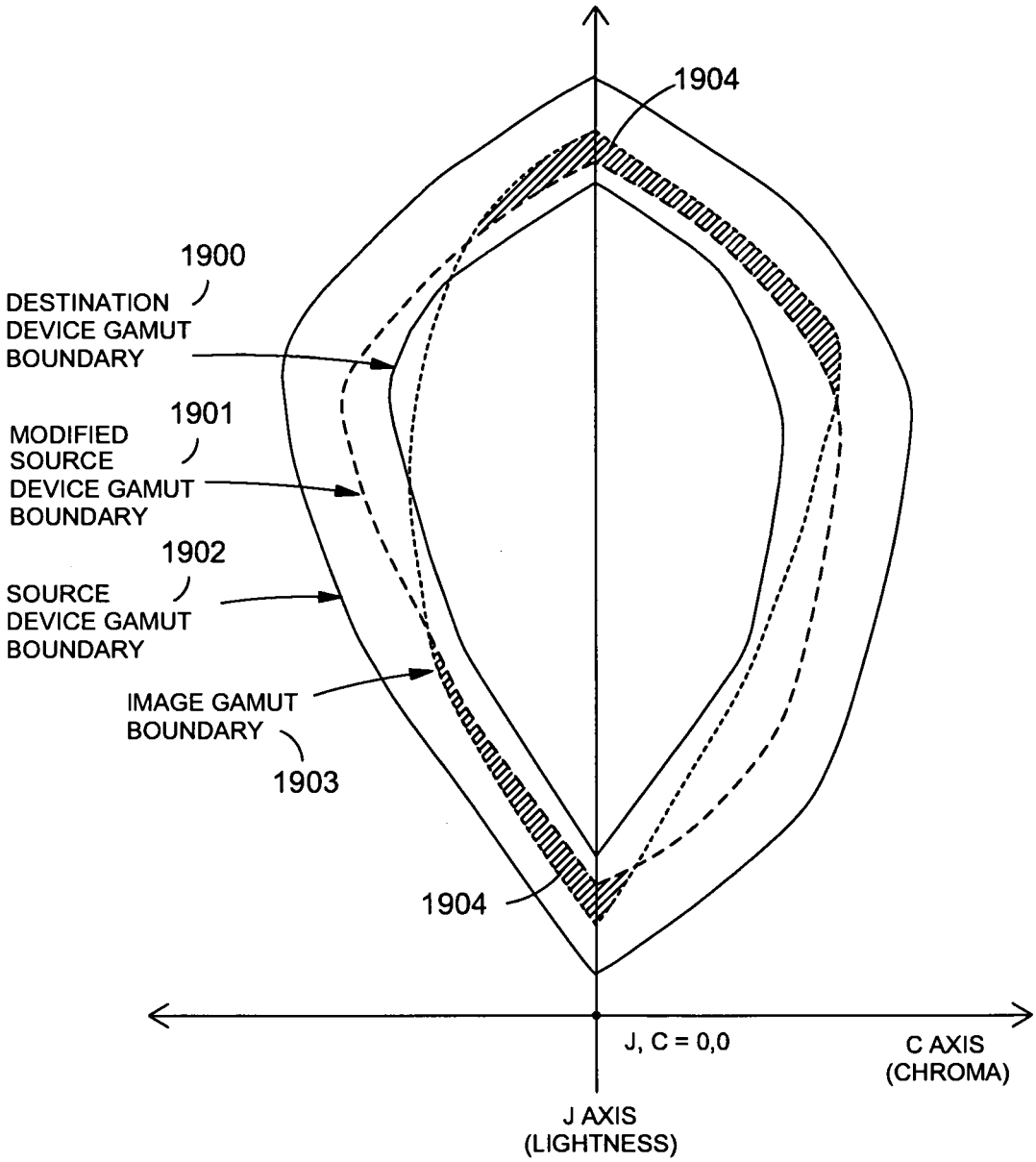
FIG. 19 is a view for explaining modification of a source device gamut boundary according to an example embodiment.

FIG. 19 is a view for explaining further shrinking of a source device gamut boundary past the image gamut boundary leaving outlying color points according to the third example embodiment. As shown in FIG. 19, when source device gamut boundary 1902 is further shrunk past image gamut boundary 1903, one or more color points that lie within image gamut boundary 1903 now lie outside modified source device gamut boundary 1901. As shown in FIG. 19, these outlying color points are included in shaded regions 1904. The outlying color points in region 1904 will lie outside of destination device gamut boundary 1900 after the compression-type GMA performs gamut mapping. The post-processing step S1705 of FIG. 17 is performed on these outlying color points to convert them into color points that lie on or within destination device gamut boundary 1900.

This disclosure has provided a detailed description with respect to particular representative embodiments. It is understood that the scope of the appended claims is not limited to the above-described embodiments and that various changes and modifications may be made without departing from the scope of the claims.

What is claimed is:

1. A color management method which converts a source-side color in a source device dependent color space into a counterpart destination-side color in a destination device dependent color space, said method comprising:

obtaining a device independent source device gamut boundary for a source device and a device independent destination device gamut boundary for a destination device;

obtaining a source color image in the source device dependent color space;

transforming the source color image into a device independent image in a device independent color space;

generating an image gamut boundary for the device independent image corresponding to the transformed source color image, based on the color content of the device independent image;

modifying the source device gamut boundary by shrinking the source device gamut boundary in a hue symmetric manner, such that hues of colors do not change, until it touches the image gamut boundary; and mapping colors of the device independent image onto a gamut of the destination device by invoking a compression-type gamut mapping algorithm that uses the modified source device gamut boundary and the destination device gamut boundary to perform gamut mapping, wherein the gamut mapped colors are converted into destination-side colors in the destination device dependent color space.

2. The method of claim 1, further comprising obtaining an intent of the compression-type gamut mapping algorithm, wherein the source device gamut boundary is shrunk according to the intent of the compression-type gamut mapping algorithm.

3. The method of claim 2, further comprising determining a compression point, based on the obtained intent of the compression-type gamut mapping algorithm, wherein the source device gamut boundary is modified by moving each point on the source device gamut boundary toward the compression point, until a point on the modified source device gamut boundary touches the image gamut boundary.

4. The method of claim 1, further comprising, responsive to a determination that the compression-type gamut mapping algorithm performs lightness scaling:

scaling a lightness of the source device gamut boundary so that maximum and minimum values of the lightness of the source device gamut boundary match maximum and minimum values of a lightness of the destination device gamut boundary, wherein the lightness-scaled source device gamut boundary is shrunk in the modifying step such that only chroma components of the source device gamut boundary are modified, wherein the modified lightness-scaled source device gamut boundary is re-scaled to an original lightness, and wherein the re-scaled source device gamut boundary is used by the compression-type gamut mapping algorithm.

5. The method of claim 4, wherein the lightness-scaled source device gamut boundary is in a color space having at least a coordinate representing lightness and a coordinate representing chroma, and wherein the lightness-scaled source device gamut boundary is modified by moving a chroma component of each point on the lightness-scaled source device gamut boundary toward an axis representing the lightness coordinate, until a point on the modified source device gamut boundary touches the image gamut boundary.

6. The method of claim 1, further comprising an additional shrinking step of further shrinking the source device gamut boundary past the image gamut boundary until a predetermined condition is satisfied.

7. The method of claim 6, wherein the predetermined condition is based on a percentage of color points of the device independent image that lie outside of the modified source device gamut boundary.

8. The method of claim 6, wherein the predetermined condition is based on a threshold number of color points of the device independent image that lie outside of the modified source device gamut boundary.

9. The method of claim 6, wherein the predetermined condition is based on a maximum distance between a color point of the device independent image that lies outside of the modified source device gamut boundary, and the modified source device gamut boundary.

10. The method of claim 6, wherein the predetermined condition is satisfied when the modified source device gamut boundary touches the destination device gamut boundary.

11. The method of claim 6, wherein the predetermined condition is selected by a user.

12. The method of claim 6, wherein the predetermined condition is selected using a graphical user interface, and wherein the graphical user interface provides a preview of a resulting image.

13. The method of claim 6, wherein after performing the additional shrinking step, one or more color points of the device independent image lie outside the modified source device gamut boundary, wherein the outlying color points of the device independent image that lie outside the modified source device gamut boundary lie outside the destination device gamut boundary after the compression-type gamut mapping algorithm performs gamut mapping, and wherein post-processing is performed to convert the outlying color points into color points that lie within the destination device gamut boundary.

14. The method of claim 13, wherein the post-processing step comprises clipping the outlying color points that lie outside of the destination device gamut boundary to a nearest color point on the destination device gamut boundary.

15. The method of claim 13, wherein a compression method is performed in the post-processing step.

16. A color management module stored on a non-transitory computer-readable memory medium which when executed by at least one processor causes the at least one processor to convert a source-side color in a source device dependent color space into a counterpart destination-side color in a destination device dependent color space, said color management module comprising:

an obtaining module constructed to obtain a device independent source device gamut boundary for a source device and a device independent destination device gamut boundary for a destination device;

an image obtaining module constructed to obtain a source color image in the source device dependent color space;

a transforming module constructed to transform the source color image into a device independent image in a device independent color space;

a gamut boundary generating module constructed to generate an image gamut boundary for the device independent image corresponding to the transformed source color image, based on color content of the device independent image;

a modifying module constructed to modify the source device gamut boundary by shrinking the source device gamut boundary in a hue symmetric manner, such that hues of colors do not change, until it touches the image gamut boundary; and a mapping module constructed to map colors of the device independent image onto a gamut of the destination device by invoking a compression-type gamut mapping algorithm that uses the modified source device gamut boundary and the destination device dependent gamut boundary to perform gamut mapping, wherein the gamut mapped colors are converted into destination-side colors in the destination device dependent color space.

17. The color management module of claim 16, further comprising an intent obtaining module constructed to obtain an intent of the compression-type gamut mapping algorithm, wherein the source device gamut boundary is shrunk according to the intent of the compression-type gamut mapping algorithm.

18. The color management module of claim 17, further comprising a determining module constructed to determine a compression point, based on the obtained intent of the compression-type gamut mapping algorithm, wherein the source device gamut boundary is modified by moving each point on the source device gamut boundary toward the compression point, until a point on the modified source device gamut boundary touches the image gamut boundary.

19. The color management module of claim 16, further comprising:

a scaling module constructed to scale a lightness of the source device gamut boundary, responsive to a determination that the compression-type gamut mapping algorithm performs lightness scaling, so that maximum and minimum values of the lightness of the source device gamut boundary match maximum and minimum values of a lightness of the destination device gamut boundary, wherein the lightness-scaled source device gamut boundary is shrunk by the modifying module such that only chroma components of the source device gamut boundary are modified, wherein the modified lightness-scaled source device gamut boundary is re-scaled to an original lightness, and wherein the re-scaled source device gamut boundary is used by the compression-type gamut mapping algorithm.

20. The color management module of claim 19, wherein the lightness-scaled source device gamut boundary is in a color space having at least a coordinate representing lightness and a coordinate representing chroma, and wherein the lightness-scaled source device gamut boundary is modified by moving a chroma component of each point on the lightness-scaled source device gamut boundary toward an axis representing the lightness coordinate, until a point on the modified source device gamut boundary touches the image gamut boundary.

21. The color management module of claim 16, further comprising an additional shrinking module constructed to further shrink the source device gamut boundary past the image gamut boundary until a predetermined condition is satisfied.

22. The color management module of claim 21, wherein the predetermined condition is based on a percentage of color points of the device independent image that lie outside of the modified source device gamut boundary.

23. The color management module of claim 21, wherein the predetermined condition is based on a threshold number of color points of the device independent image that lie outside of the modified source device gamut boundary.

24. The color management module of claim 21, wherein the predetermined condition is based on a maximum distance between a color point of the device independent image that lies outside of the modified source device gamut boundary, and the modified source device gamut boundary.

25. The color management module of claim 21, wherein the predetermined condition is satisfied when the modified source device gamut boundary touches the destination device gamut boundary.

26. The color management module of claim 21, wherein the predetermined condition is selected by a user.

27. The color management module of claim 21, wherein the predetermined condition is selected using a graphical user interface, and wherein the graphical user interface provides a preview of a resulting image.

28. The color management module of claim 21, further comprising a post-processing module constructed to process color points of the device independent image that lie outside the modified source device gamut boundary after the additional shrinking module performs shrinking, wherein the outlying color points of the device independent image that lie outside the modified source device gamut boundary lie outside the destination device gamut boundary after the compression-type gamut mapping algorithm performs gamut mapping, and wherein the post-processing module converts the outlying color points into color points that lie within the destination device gamut boundary.

29. The color management module of claim 28, wherein the post-processing module clips the outlying color points that lie outside of the destination device gamut boundary to a nearest color point on the destination device gamut boundary.

30. The color management module of claim 28, wherein a compression method is performed by the post-processing module.

31. A color management apparatus comprising:

a computer-readable memory constructed to store computer-executable process steps; and a processor constructed to execute the computer-executable process steps stored in the memory;

wherein the process steps stored in the memory cause the processor to convert source-side colors in a source device dependent color space into counterpart destination-side colors in a destination device dependent color space, and include computer-executable process steps to:

obtain a device independent source device gamut boundary for a source device and a device independent destination device gamut boundary for a destination device;

obtain a source color image in the source device dependent color space;

transform the source color image into a device independent image in a device independent color space;

generate an image gamut boundary for the device independent image corresponding to the transformed source color image, based on color content of the device independent image;

modify the source device gamut boundary by shrinking the source device gamut boundary in a hue symmetric manner, such that hues of colors do not change, until it touches the image gamut boundary; and map colors of the device independent image onto a gamut of the destination device by invoking a compression-type gamut mapping algorithm that uses the modified source device gamut boundary and the destination device dependent gamut boundary to perform gamut mapping, wherein the gamut mapped colors are converted into destination-side colors in the destination device dependent color space.

32. The apparatus of claim 31, wherein the process steps further include process steps to obtain an intent of the compression-type gamut mapping algorithm, wherein the source device gamut boundary is shrunk according to the intent of the compression-type gamut mapping algorithm.

33. The apparatus of claim 32, wherein the process steps further include process steps to determine a compression point, based on the obtained intent of the compression-type gamut mapping algorithm, wherein the source device gamut boundary is modified by moving each point on the source device gamut boundary toward the compression point, until a point on the modified source device gamut boundary touches the image gamut boundary.

34. The apparatus of claim 31, wherein the process steps further include process steps to, responsive to a determination that the compression-type gamut mapping algorithm performs lightness scaling:

scale a lightness of the source device gamut boundary so that maximum and minimum values of the lightness of the source device gamut boundary match maximum and minimum values of a lightness of the destination device gamut boundary, wherein the lightness-scaled source device gamut boundary is shrunk in the modifying step such that only chroma components of the source device gamut boundary are modified, wherein the modified lightness-scaled source device gamut boundary is re-scaled to an original lightness, and wherein the re-scaled source device gamut boundary is used by the compression-type gamut mapping algorithm.

35. The apparatus of claim 34, wherein the lightness-scaled source device gamut boundary is in a color space having at least a coordinate representing lightness and a coordinate representing chroma, and wherein the lightness-scaled source device gamut boundary is modified by moving a chroma component of each point on the lightness-scaled source device gamut boundary toward an axis representing the lightness coordinate, until a point on the modified source device gamut boundary touches the image gamut boundary.

36. The apparatus of claim 31, wherein the process steps further include additional shrinking process steps to further shrink the source device gamut boundary past the image gamut boundary until a predetermined condition is satisfied.

37. The apparatus of claim 36, wherein the predetermined condition is based on a percentage of color points of the device independent image that lie outside of the modified source device gamut boundary.

38. The apparatus of claim 36, wherein the predetermined condition is based on a threshold number of color points of the device independent image that lie outside of the modified source device gamut boundary.

39. The apparatus of claim 36, wherein the predetermined condition is based on a maximum distance between a color point of the device independent image that lies outside of the modified source device gamut boundary, and the modified source device gamut boundary.

40. The apparatus of claim 36, wherein the predetermined condition is satisfied when the modified source device gamut boundary touches the destination device gamut boundary.

41. The apparatus of claim 36, wherein the predetermined condition is selected by a user.

42. The apparatus of claim 36, wherein the predetermined condition is selected using a graphical user interface, and wherein the graphical user interface provides preview of a resulting image.

43. The apparatus of claim 36, wherein after the additional shrinking process steps perform shrinking, one or more color points of the device independent image lie outside the modified source device gamut boundary, wherein the outlying color points of the device independent image that lie outside the modified source device gamut boundary lie outside the destination device gamut boundary after the compression-type gamut mapping algorithm performs gamut mapping, and wherein post-processing is performed to convert the outlying color points into color points that lie within the destination device gamut boundary.

44. The apparatus of claim 43, wherein post-processing comprises clipping the outlying color points that lie outside of the destination device gamut boundary to a nearest color point on the destination device gamut boundary.

45. The apparatus of claim 43, wherein a compression method is performed during post-processing.

46. A non-transitory computer-readable memory medium on which is stored computer-executable process steps for causing a computer to convert a source-side color in a source device dependent color space into a counterpart destination-side color in a destination device dependent color space, said process steps comprising:

obtaining a device independent source device gamut boundary for a source device and a device independent destination device gamut boundary for a destination device;

obtaining a source color image in the source device dependent color space;

transforming the source color image into a device independent image in a device independent color space;

generating an image gamut boundary for the device independent image corresponding to the transformed source color image, based on the color content of the device independent image;

modifying the source device gamut boundary by shrinking the source device gamut boundary in a hue symmetric manner, such that hues of colors do not change, until it touches the image gamut boundary; and mapping colors of the device independent image onto a gamut of the destination device by invoking a compression-type gamut mapping algorithm that uses the modified source device gamut boundary and the destination device gamut boundary to perform gamut mapping, wherein the gamut mapped colors are converted into destination-side colors in the destination device dependent color space.

47. The computer-readable memory medium of claim 46, wherein the process steps further comprise obtaining an intent of the compression-type gamut mapping algorithm, wherein the source device gamut boundary is shrunk according to the intent of the compression-type gamut mapping algorithm.

48. The computer-readable memory medium of claim 47, wherein the process steps further comprise determining a compression point, based on the obtained intent of the compression-type gamut mapping algorithm, wherein the source device gamut boundary is modified by moving each point on the source device gamut boundary toward the compression point, until a point on the modified source device gamut boundary touches the image gamut boundary.

49. The computer-readable memory medium of claim 46, wherein the process steps further comprise, that the compression-type gamut mapping algorithm performs lightness scaling:

scaling a lightness of the source device gamut boundary so that maximum and minimum values of the lightness of the source device gamut boundary match maximum and minimum values of a lightness of the destination device gamut boundary, wherein the lightness-scaled source device gamut boundary is shrunk in the modifying step such that only chroma components of the source device gamut boundary are modified, wherein the modified lightness-scaled source device gamut boundary is re-scaled to an original lightness, and wherein the re-scaled source device gamut boundary is used by the compression-type gamut mapping algorithm.

50. The computer-readable memory medium of claim 49, wherein the lightness-scaled source device gamut boundary is in a color space having at least a coordinate representing lightness and a coordinate representing chroma, and wherein the lightness-scaled source device gamut boundary is modified by moving a chroma component of each point on the lightness-scaled source device gamut boundary toward an axis representing the lightness coordinate, until a point on the modified source device gamut boundary touches the image gamut boundary.

51. The computer-readable memory medium of claim 46, wherein the process steps comprise an additional shrinking step of further shrinking the source device gamut boundary past the image gamut boundary until a predetermined condition is satisfied.

52. The computer-readable memory medium of claim 51, wherein the predetermined condition is based on a percentage of color points of the device independent image that lie outside of the modified source device gamut boundary.

53. The computer-readable memory medium of claim 51, wherein the predetermined condition is based on a threshold number of color points of the device independent image that lie outside of the modified source device gamut boundary.

54. The computer-readable memory medium of claim 51, wherein the predetermined condition is based on a maximum distance between a color point of the device independent image that lies outside of the modified source device gamut boundary, and the modified source device gamut boundary.

55. The computer-readable memory medium of claim 51, wherein the predetermined condition is satisfied when the modified source device gamut boundary touches the destination device gamut boundary.

56. The computer-readable memory medium of claim 51, wherein the predetermined condition is selected by a user.

57. The computer-readable memory medium of claim 51, wherein the predetermined condition is selected using a graphical user interface, and wherein the graphical user interface provides a preview of a resulting image.

58. The computer-readable memory medium of claim 51, wherein after performing the additional shrinking step, one or more color points of the device independent image lie outside the modified source device gamut boundary, wherein the outlying color points of the device independent image that lie outside the modified source device gamut boundary lie outside the destination device gamut boundary after the compression-type gamut mapping algorithm performs gamut mapping, and wherein post-processing is performed to convert the outlying color points into color points that lie within the destination device gamut boundary.

59. The computer-readable memory medium of claim 58, wherein the post-processing step comprises clipping the outlying color points that lie outside of the destination device gamut boundary to a nearest color point on the destination device gamut boundary.

60. The computer-readable memory medium of claim 58, wherein a compression method is performed in the post-processing step.

* * * * *